US010709955B2

(12) United States Patent
Elford et al.

(10) Patent No.: US 10,709,955 B2
(45) Date of Patent: Jul. 14, 2020

(54) ATHLETIC DATA AGGREGATION FOR ONLINE COMMUNITIES

(71) Applicant: NIKE, Inc., Beaverton, OR (US)

(72) Inventors: Michael C. Elford, Portland, OR (US); Owyn Richen, Portland, OR (US); Homero Trevino Lopez, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 15/458,540

(22) Filed: Mar. 14, 2017

(65) Prior Publication Data

US 2017/0266531 A1 Sep. 21, 2017

Related U.S. Application Data

(60) Provisional application No. 62/308,623, filed on Mar. 15, 2016.

(51) Int. Cl.

| | |
|---|---|
| ***A63B 71/06*** | (2006.01) |
| ***G06Q 50/00*** | (2012.01) |
| ***A63B 24/00*** | (2006.01) |

(52) U.S. Cl.

CPC ..... *A63B 71/0616* (2013.01); *A63B 24/0062* (2013.01); *G06Q 50/01* (2013.01); *A63B 2220/20* (2013.01); *A63B 2220/62* (2013.01)

(58) Field of Classification Search

CPC ..... A63B 71/0616; A63B 24/0062; A63B 2220/20; A63B 2220/62; G06Q 50/01

See application file for complete search history.

(56) References Cited

U.S. PATENT DOCUMENTS

| | | | | |
|---|---|---|---|---|
| 9,757,619 | B2 * | 9/2017 | Meschter | G06F 19/3481 |
| 2008/0200312 | A1 * | 8/2008 | Tagliabue | G01C 22/006 482/9 |
| 2012/0059690 | A1 * | 3/2012 | Ruckart | G06Q 30/0207 705/14.1 |
| 2012/0251079 | A1 * | 10/2012 | Meschter | G06F 19/3481 386/278 |
| 2012/0322561 | A1 * | 12/2012 | Kohlhoff | A63F 13/10 463/42 |
| 2013/0197679 | A1 * | 8/2013 | Balakrishnan | G06F 17/40 700/91 |
| 2014/0012861 | A1 * | 1/2014 | Bradsher | G06F 16/958 707/748 |
| 2014/0248952 | A1 * | 9/2014 | Cibula | H04W 4/14 463/31 |

(Continued)

FOREIGN PATENT DOCUMENTS

EP 2703932 A1 3/2014

OTHER PUBLICATIONS

Jun. 6, 2017—(WO) ISR & WO—App. No. PCT/US17/022467.

*Primary Examiner* — Corbett B Coburn
(74) *Attorney, Agent, or Firm* — Banner & Witcoff, Ltd.

(57) ABSTRACT

Systems and methods are provided for monitoring athletic performance data for a plurality of users and motivating increased athletic activity among users by providing challenges and suggestion for improving athletic performance. User athletic performance data and other information may be associated with user communications using one or more identifiers and displayed to the user via an interface, including user leaderboards and other interface displays.

20 Claims, 13 Drawing Sheets

(56) References Cited

U.S. PATENT DOCUMENTS

| | | | | |
|---|---|---|---|---|
| 2014/0337450 | A1* | 11/2014 | Choudhary | H04L 51/00 709/206 |
| 2015/0057944 | A1* | 2/2015 | White | A61B 5/0022 702/19 |
| 2015/0058237 | A1* | 2/2015 | Bailey | G08C 17/02 705/319 |
| 2015/0081062 | A1* | 3/2015 | Fyfe | G06F 19/3481 700/91 |
| 2015/0217163 | A1* | 8/2015 | Amis | A61B 5/0022 700/91 |
| 2015/0242434 | A1* | 8/2015 | Wollenstein | G06F 17/3053 707/749 |
| 2016/0078471 | A1* | 3/2016 | Hamedi | G06F 16/24578 705/14.41 |
| 2016/0203577 | A1* | 7/2016 | Bell | G07F 17/3223 715/753 |
| 2016/0267747 | A1* | 9/2016 | Dengler | G07F 17/3288 |
| 2018/0056132 | A1* | 3/2018 | Foley | A63B 22/025 |
| 2018/0126248 | A1* | 5/2018 | Dion | A63B 71/0622 |
| 2018/0126249 | A1* | 5/2018 | Consiglio | A63F 13/245 |
| 2018/0140903 | A1* | 5/2018 | Poure | A63B 24/0075 |

* cited by examiner

ATHLETIC DATA AGGREGATION FOR ONLINE COMMUNITIES

RELATED APPLICATIONS

The present application claims priority to U.S. Provisional Patent Application Ser. No. 62/308,623, which was filed on Mar. 15, 2016. The above-referenced application is entirely incorporated by reference.

BACKGROUND

Exercise and fitness have become increasingly popular and the benefits from such activities are well known. Various types of technology have been incorporated into fitness and other athletic activities. For example, a wide variety of portable electronic devices are available for use in fitness activity such as MP3 or other audio players, radios, portable televisions, DVD players, or other video playing devices, watches, GPS systems, pedometers, mobile telephones, pagers, beepers, etc. Many fitness enthusiasts or athletes use one or more of these devices when exercising or training to keep them entertained, provide performance data or to keep them in contact with others, etc. Such users have also demonstrated an interest in recording their athletic activities and metrics associated therewith. Accordingly, various sensors may be used to detect, store and/or transmit athletic performance information. Oftentimes, however, athletic performance information is presented in a vacuum or based on the overall athletic activity. Exercisers may be interested in obtaining additional information about their workouts. Furthermore, users are interested in sharing their athletic activities and performance data with other users or communities of users.

While most people appreciate the importance of physical fitness, many have difficulty finding the motivation required to maintain a regular exercise program. Some people find it particularly difficult to maintain an exercise regimen that involves continuously repetitive motions, such as running, walking and bicycling. Additionally, oftentimes, individuals might not be as motivated to exercise because of the extra effort that may be required in recording and tracking workout results. For example, an individual may be required to manually enter workout information such as a number of miles run, a route run, an average heart rate and the like, into a database in order to track his or her progress.

In another example, individuals may need to use special fitness-dedicated devices to automatically track workout results. In some instances, different types of fitness equipment may be required depending on if the individual is working out indoors or outdoors, on a treadmill or running an outdoor route and the like. Furthermore, users may find it difficult and onerous to share athletic information with communities of users, and to find new and interesting ways to challenge themselves and compete with other users.

Motivation may also result from achieving progress in an individual's fitness level. However, progress often involves increasing or otherwise altering a workout regimen. For example, individuals may start running faster or for longer periods of time to increase endurance. In some cases, individuals might repeat the same workout, thus failing to challenge themselves to improve on previous performances. Without being prompted to perform a more strenuous workout, an individual might not see results as quickly or at all and thus become unmotivated.

SUMMARY

The following presents a general summary of example aspects to provide a basic understanding of example embodiments. This summary is not an extensive overview. It is not intended to identify key or critical elements or to delineate scope of the invention. The following summary merely presents some concepts of the invention in a general form as a prelude to the more detailed description provided below.

One or more aspects describe systems, apparatuses, computer readable media, and methods for tracking performance metrics of a user during an exercise session.

In some example aspects, the systems, apparatuses, computer readable media, and methods may include receiving data generated by a sensor (e.g., an accelerometer, a force sensor, temperature sensor, heart rate monitor, etc.) as a user performs an athletic movement, and generating performance metrics based on the obtained athletic activity data.

In other example aspects, the systems, apparatuses, computer readable media, and methods may be configured to broadcast to various users a communication indicating an athletic activity performed by a user; determine an identifier associated with the communication; determine a plurality of other communications corresponding to the identifier; receive performance data for other users associated with the plurality of other communications; and generate a leaderboard indicating a ranking of the first user and the plurality of other users in accordance with a particular performance metric.

According to one or more aspects, a user may record and track athletic activity using a mobile device having multiple types of location determination systems such as a global positioning system (GPS) and an accelerometer or other types of devices (e.g., pedometer) not dependent on remote systems. By using both a GPS device and an accelerometer, the mobile device may record workout data for both indoor (e.g., stationary) workouts and outdoor workouts. The mobile device may switch from using one device to the other device depending on the conditions.

According to yet another aspect, a user may synchronize data to and view data from an athletic activity monitoring service provider. The user may download data to a mobile fitness monitoring device to track historical runs and his or her progress over a specified period of time. Additionally or alternatively, some data may be stored locally in the user's mobile device and supplemented with data from a remote network site (e.g., the athletic activity monitoring service provider). Further, data recorded by the mobile device (e.g., GPS data or accelerometer data) may be synchronized with the remote network site to alleviate storage requirements of the mobile device. Additionally, synchronization with the remote network site may allow the user to view athletic activity information from other locations and devices. Further, the workout information may be shared through one or more social outlets. According to another aspect, runs completed using a location determination device may be stored with route information. Route information includes the path taken by the user during the workout. The route may be displayed against a map to allow the user to view various information and statistics about the run.

According to yet another aspect, a mobile athletic activity monitoring device may further offer comments, suggestions and words of encouragement to the user pre-, mid- and post-run or athletic workout. For example, if a user reaches a predefined distance during a run, the device may generate and render text, audio and/or video messages to the user. In one or more arrangements, celebrity messages may be included as a congratulatory or motivational message. In another example, congratulatory or motivational messages may be provided based on a set trigger such as reaching a certain distance or achieving a specified pace. In one arrangement, a user may be provided with certain sound, visual or haptic feedback upon receiving a threshold number of messages from friends (e.g., through a social networking site such as TWITTER or FACEBOOK).

Still further, a user may tag or otherwise associate various parameters and notes with a workout session. The tags, notes and/or parameters, in some instances, may be automatically detected. For example, weather, terrain, incline, elevation, body temperature and the like may be automatically registered as a parameter or tagged parameter of a workout session based on information that is determined through devices such as a GPS receiver, heart rate monitor, gyroscopes, accelerometers, thermometers and the like. In some examples, athletic equipment used during a workout may be tagged. This information may then be used to monitor wear on the athletic equipment, recommend new, supplemental and/or replacement equipment, determine what equipment provides better results and the like.

According to still another aspect, methods and systems for automatically identifying and matching a user with other challenge participants may be provided. For example, the system may receive a request to initiate a run and to challenge one or more other users to the run from a first user. The system may allow the user to select and invite particular users to be challenged or, alternatively or additionally, automatically identify such other users. In one example, attributes of the first user may be determined and compared to the attributes of other users. The system might only identify challenges that are currently online. The identified users may then be invited to participate in the challenge. If a user accepts the challenge, the participants may compete in the challenge, at the conclusion of which, a winner may be declared. Rewards, accolades and other recognition may be provided to the winner. Additionally or alternatively, the system may automatically suggest a schedule for a further challenge between the two participants to encourage improvement and athletic activity.

In the following description of the various embodiments, reference is made to the accompanying drawings, which form a part hereof, and in which is shown by way of illustration various embodiments in which aspects of the disclosure may be practiced. It is to be understood that other embodiments may be utilized and structural and functional modifications may be made without departing from the scope and spirit of the present disclosure. Further, headings within this disclosure should not be considered as limiting aspects of the disclosure and the example embodiments are not limited to the example headings.

DETAILED DESCRIPTION

In the following description of the various embodiments, reference is made to the accompanying drawings, which form a part hereof, and in which is shown by way of illustration various embodiments in which the disclosure may be practiced. It is to be understood that other embodiments may be utilized and structural and functional modifications may be made without departing from the scope and spirit of the present disclosure. Further, headings within this disclosure should not be considered as limiting aspects of the disclosure. Those skilled in the art with the benefit of this disclosure will appreciate that the example embodiments are not limited to the example headings.

I. Example Personal Training System

A. Illustrative Networks

Figure 1:
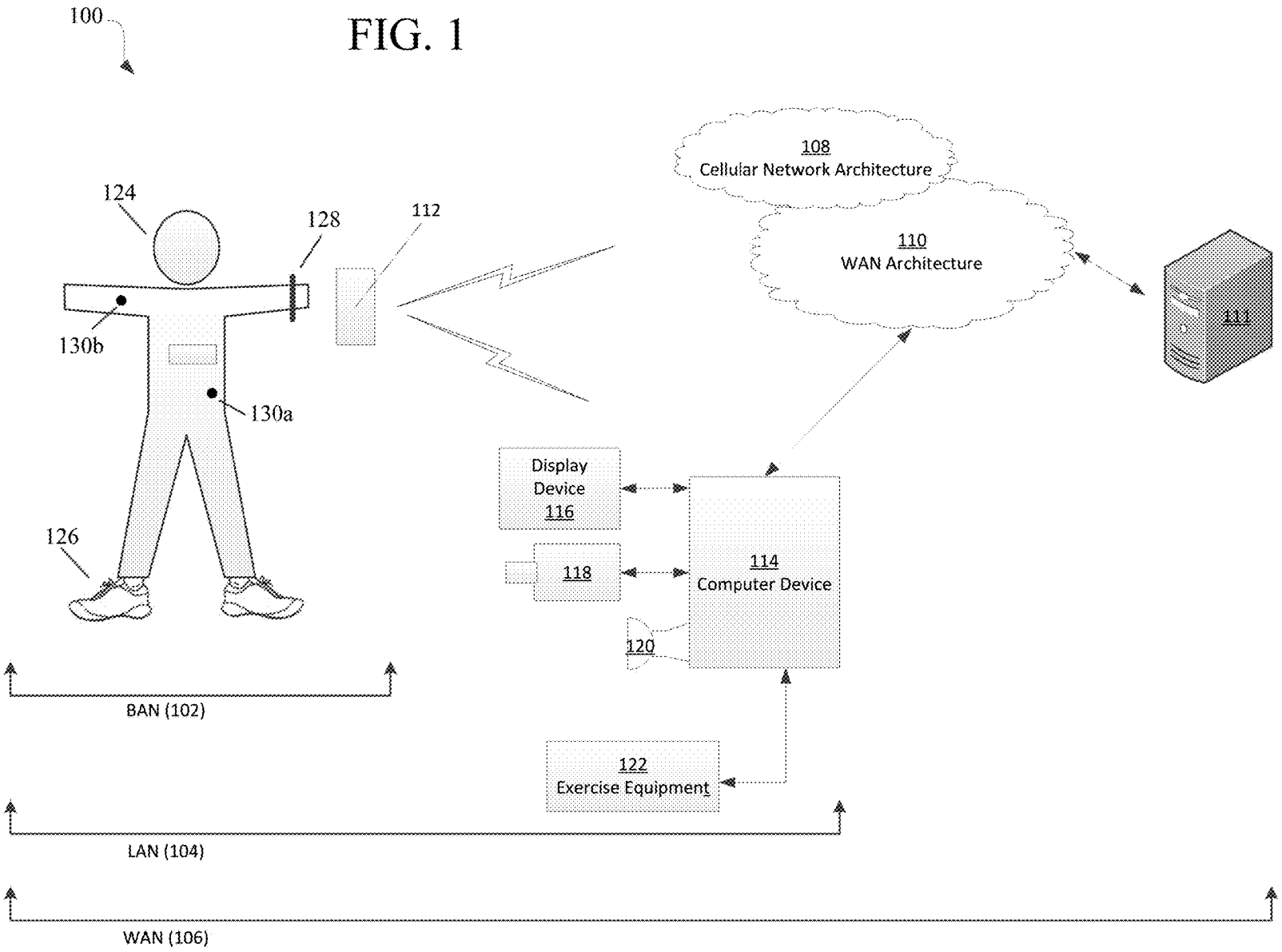
FIG. 1 illustrates an example system that may be configured to provide personal training and/or obtain data from the physical movements of a user in accordance with example embodiments.

Aspects of this disclosure relate to systems and methods that may be utilized across a plurality of networks. In this regard, certain embodiments may be configured to adapt to dynamic network environments. Further embodiments may be operable in differing discrete network environments. FIG. 1 illustrates an example of a personal training system 100 in accordance with example embodiments. Example system 100 may include one or more interconnected networks, such as the illustrative body area network (BAN) 102, local area network (LAN) 104, and wide area network (WAN) 106. As shown in FIG. 1 (and described throughout this disclosure), one or more networks (e.g., BAN 102, LAN 104, and/or WAN 106), may overlap or otherwise be inclusive of each other. Those skilled in the art will appreciate that the illustrative networks 102-106 are logical networks that may each comprise one or more different communication protocols and/or network architectures and yet may be configured to have gateways to each other or other networks. For example, each of BAN 102, LAN 104 and/or WAN 106 may be operatively connected to the same physical network architecture, such as cellular network architecture 108 and/or WAN architecture 110. For example, portable electronic device 112, which may be considered a component of both BAN 102 and LAN 104, may comprise a network adapter or network interface card (NIC) configured to translate data and control signals into and from network messages according to one or more communication protocols, such as the Transmission Control Protocol (TCP), the Internet Protocol (IP), and the User Datagram Protocol (UDP) through one or more of architectures 108 and/or 110. These protocols are well known in the art, and thus will not be discussed here in more detail.

Network architectures 108 and 110 may include one or more information distribution network(s), of any type(s) or topology(s), alone or in combination(s), such as for example, cable, fiber, satellite, telephone, cellular, wireless, etc. and as such, may be variously configured such as having one or more wired or wireless communication channels (including but not limited to: WiFi®, Bluetooth®, Near-Field Communication (NFC) and/or ANT technologies). Thus, any device within a network of FIG. 1, (such as portable electronic device 112 or any other device described herein) may be considered inclusive to one or more of the different logical networks 102-106. With the foregoing in mind, example components of an illustrative BAN and LAN (which may be coupled to WAN 106) will be described.

1. Example Local Area Network

LAN 104 may include one or more electronic devices, such as for example, computer device 114. Computer device 114, or any other component of system 100, may comprise a mobile terminal, such as a telephone, music player, tablet, netbook or any portable device. In other embodiments, computer device 114 may comprise a media player or recorder, desktop computer, server(s), a gaming console, such as for example, a Microsoft® XBOX, Sony® Playstation, and/or a Nintendo® Wii gaming consoles. Those skilled in the art will appreciate that these are merely example devices for descriptive purposes and this disclosure is not limited to any console or computing device.

Figure 2:
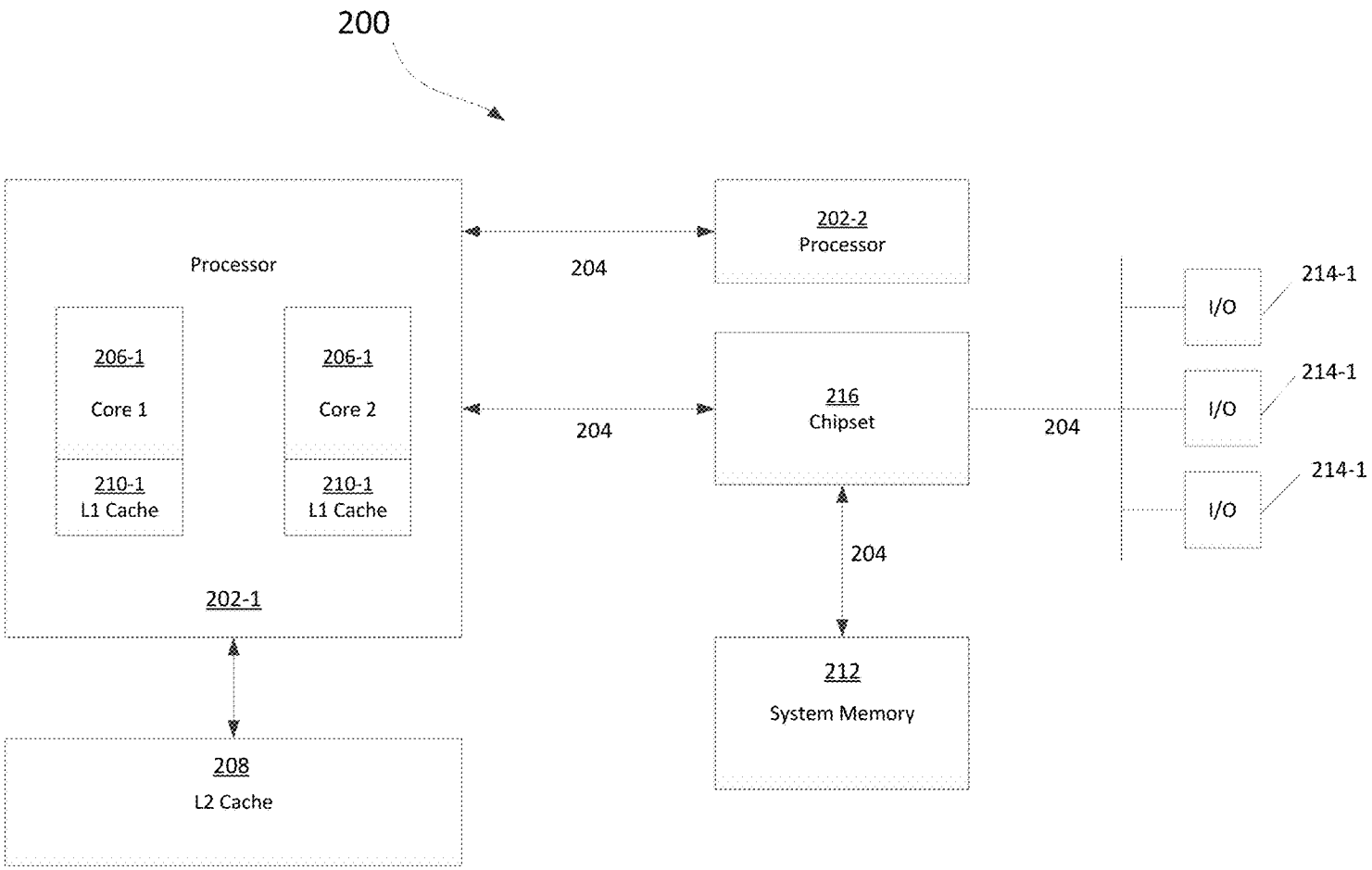
FIG. 2 illustrates an example computer device that may be part of or in communication with the system of FIG. 1.

Those skilled in the art will appreciate that the design and structure of computer device 114 may vary depending on several factors, such as its intended purpose. One example implementation of computer device 114 is provided in FIG. 2, which illustrates a block diagram of computing device 200. Those skilled in the art will appreciate that the disclosure of FIG. 2 may be applicable to any device disclosed herein. Device 200 may include one or more processors, such as processor 202-1 and 202-2 (generally referred to herein as "processors 202" or "processor 202"). Processors 202 may communicate with each other or other components via an interconnection network or bus 204. Processor 202 may include one or more processing cores, such as cores 206-1 and 206-2 (referred to herein as "cores 206" or more generally as "core 206"), which may be implemented on a single integrated circuit (IC) chip.

Cores 206 may comprise a shared cache 208 and/or a private cache (e.g., caches 210-1 and 210-2, respectively). One or more caches 208/210 may locally cache data stored in a system memory, such as memory 212, for faster access by components of the processor 202. Memory 212 may be in communication with the processors 202 via a chipset 216. Cache 208 may be part of system memory 212 in certain embodiments. Memory 212 may include, but is not limited to, random access memory (RAM), read only memory (ROM), and include one or more of solid-state memory, optical or magnetic storage, and/or any other medium that can be used to store electronic information. Yet other embodiments may omit system memory 212.

System 200 may include one or more I/O devices (e.g., I/O devices 214-1 through 214-3, each generally referred to as I/O device 214). I/O data from one or more I/O devices 214 may be stored at one or more caches 208, 210 and/or system memory 212. Each of I/O devices 214 may be permanently or temporarily configured to be in operative communication with a component of system 100 using any physical or wireless communication protocol.

Returning to FIG. 1, four example I/O devices (shown as elements 116-122) are shown as being in communication with computer device 114. Those skilled in the art will appreciate that one or more of devices 116-122 may be stand-alone devices or may be associated with another device besides computer device 114. For example, one or more I/O devices may be associated with or interact with a component of BAN 102 and/or WAN 106. I/O devices 116-122 may include, but are not limited to athletic data acquisition units, such as for example, sensors. One or more I/O devices may be configured to sense, detect, and/or measure an athletic parameter from a user, such as user 124. Examples include, but are not limited to: an accelerometer, a gyroscope, a location-determining device (e.g., GPS), light (including non-visible light) sensor, temperature sensor (including ambient temperature and/or body temperature), sleep pattern sensors, heart rate monitor, image-capturing sensor, moisture sensor, force sensor, compass, angular rate sensor, and/or combinations thereof among others.

In further embodiments, I/O devices 116-122 may be used to provide an output (e.g., audible, visual, or tactile cue) and/or receive an input, such as a user input from athlete 124. Example uses for these illustrative I/O devices are provided below, however, those skilled in the art will appreciate that such discussions are merely descriptive of some of the many options within the scope of this disclosure. Further, reference to any data acquisition unit, I/O device, or sensor is to be interpreted disclosing an embodiment that may have one or more I/O device, data acquisition unit, and/or sensor disclosed herein or known in the art (either individually or in combination).

Information from one or more devices (across one or more networks) may be used to provide (or be utilized in the formation of) a variety of different parameters, metrics or physiological characteristics including but not limited to: motion parameters, such as speed, acceleration, distance, steps taken, direction, relative movement of certain body portions or objects to others, or other motion parameters which may be expressed as angular rates, rectilinear rates or combinations thereof, physiological parameters, such as calories, heart rate, sweat detection, effort, oxygen consumed, oxygen kinetics, and other metrics which may fall within one or more categories, such as: pressure, impact forces, information regarding the athlete, such as height, weight, age, demographic information and combinations thereof.

System 100 may be configured to transmit and/or receive athletic data, including the parameters, metrics, or physiological characteristics collected within system 100 or otherwise provided to system 100. As one example, WAN 106 may comprise server 111. Server 111 may have one or more components of system 200 of FIG. 2. In one embodiment, server 111 comprises at least a processor and a memory, such as processor 206 and memory 212. Server 111 may be configured to store computer-executable instructions on a non-transitory computer-readable medium. The instructions may comprise athletic data, such as raw or processed data collected within system 100. System 100 may be configured to transmit data, such as energy expenditure points, to a social networking website or host such a site. Server 111 may be utilized to permit one or more users to access and/or compare athletic data. As such, server 111 may be configured to transmit and/or receive notifications based upon athletic data or other information.

Returning to LAN 104, computer device 114 is shown in operative communication with a display device 116, an image-capturing device 118, sensor 120 and exercise device 122, which are discussed in turn below with reference to example embodiments. In one embodiment, display device 116 may provide audio-visual cues to athlete 124 to perform a specific athletic movement. The audio-visual cues may be provided in response to computer-executable instruction executed on computer device 114 or any other device, including a device of BAN 102 and/or WAN. Display device 116 may be a touchscreen device or otherwise configured to receive a user-input.

In one embodiment, data may be obtained from image-capturing device 118 and/or other sensors, such as sensor 120, which may be used to detect (and/or measure) athletic parameters, either alone or in combination with other devices, or stored information.

Image-capturing device 118 and/or sensor 120 may comprise a transceiver device. In one embodiment sensor 120 may comprise an infrared (IR), electromagnetic (EM) or acoustic transceiver. For example, image-capturing device 118, and/or sensor 120 may transmit waveforms into the environment, including towards the direction of athlete 124 and receive a "reflection" or otherwise detect alterations of those released waveforms. Those skilled in the art will readily appreciate that signals corresponding to a multitude of different data spectrums may be utilized in accordance with various embodiments. In this regard, devices 118 and/or 120 may detect waveforms emitted from external sources (e.g., not system 100). For example, devices 118 and/or 120 may detect heat being emitted from user 124 and/or the surrounding environment. Thus, image-capturing device 118 and/or sensor 120 may comprise one or more thermal imaging devices. In one embodiment, image-capturing device 118 and/or sensor 120 may comprise an IR device configured to perform range phenomenology.

In one embodiment, exercise device 122 may be any device configurable to permit or facilitate the athlete 124 performing a physical movement, such as for example a treadmill, step machine, etc. There is no requirement that the device be stationary. In this regard, wireless technologies permit portable devices to be utilized, thus a bicycle or other mobile exercising device may be utilized in accordance with certain embodiments. Those skilled in the art will appreciate that equipment 122 may be or comprise an interface for receiving an electronic device containing athletic data performed remotely from computer device 114. For example, a user may use a sporting device (described below in relation to BAN 102) and upon returning home or the location of equipment 122, download athletic data into element 122 or any other device of system 100. Any I/O device disclosed herein may be configured to receive activity data.

2. Body Area Network

BAN 102 may include two or more devices configured to receive, transmit, or otherwise facilitate the collection of athletic data (including passive devices). Exemplary devices may include one or more data acquisition units, sensors, or devices known in the art or disclosed herein, including but not limited to I/O devices 116-122. Two or more components of BAN 102 may communicate directly, yet in other embodiments, communication may be conducted via a third device, which may be part of BAN 102, LAN 104, and/or WAN 106. One or more components of LAN 104 or WAN 106 may form part of BAN 102. In certain implementations, whether a device, such as portable device 112, is part of BAN 102, LAN 104, and/or WAN 106, may depend on the athlete's proximity to an access point to permit communication with mobile cellular network architecture 108 and/or WAN architecture 110. User activity and/or preference may also influence whether one or more components are utilized as part of BAN 102. Example embodiments are provided below.

User 124 may be associated with (e.g., possess, carry, wear, and/or interact with) any number of devices, such as portable device 112, shoe-mounted device 126, wrist-worn device 128 and/or a sensing location, such as sensing location 130, which may comprise a physical device or a location that is used to collect information. One or more devices 112, 126, 128, and/or 130 may not be specially designed for fitness or athletic purposes. Indeed, aspects of this disclosure relate to utilizing data from a plurality of devices, some of which are not fitness devices, to collect, detect, and/or measure athletic data. In certain embodiments, one or more devices of BAN 102 (or any other network) may comprise a fitness or sporting device that is specifically designed for a particular sporting use. As used herein, the term "sporting device" includes any physical object that may be used or implicated during a specific sport or fitness activity. Exemplary sporting devices may include, but are not limited to: golf balls, basketballs, baseballs, soccer balls, footballs, powerballs, hockey pucks, weights, bats, clubs, sticks, paddles, mats, and combinations thereof. In further embodiments, exemplary fitness devices may include objects within a sporting environment where a specific sport occurs, including the environment itself, such as a goal net, hoop, backboard, portions of a field, such as a midline, outer boundary marker, base, and combinations thereof.

In this regard, those skilled in the art will appreciate that one or more sporting devices may also be part of (or form) a structure and vice-versa, a structure may comprise one or more sporting devices or be configured to interact with a sporting device. For example, a first structure may comprise a basketball hoop and a backboard, which may be removable and replaced with a goal post. In this regard, one or more sporting devices may comprise one or more sensors, such as one or more of the sensors discussed above in relation to FIGS. 1-3, that may provide information utilized, either independently or in conjunction with other sensors, such as one or more sensors associated with one or more structures. For example, a backboard may comprise a first sensor configured to measure a force and a direction of the force by a basketball upon the backboard and the hoop may comprise a second sensor to detect a force. Similarly, a golf club may comprise a first sensor configured to detect grip attributes on the shaft and a second sensor configured to measure impact with a golf ball.

Looking to the illustrative portable device 112, it may be a multi-purpose electronic device, that for example, includes a telephone or digital music player, including an IPOD®, IPAD®, or iPhone®, brand devices available from Apple, Inc. of Cupertino, Calif. or Zune® or Microsoft® Windows devices available from Microsoft of Redmond, Wash. As known in the art, digital media players can serve as an output device, input device, and/or storage device for a computer. Device 112 may be configured as an input device for receiving raw or processed data collected from one or more devices in BAN 102, LAN 104, or WAN 106. In one or more embodiments, portable device 112 may comprise one or more components of computer device 114. For example, portable device 112 may be include a display 116, image-capturing device 118, and/or one or more data acquisition devices, such as any of the I/O devices 116-122 discussed above, with or without additional components, so as to comprise a mobile terminal.

a. Illustrative Apparel/Accessory Sensors

In certain embodiments, I/O devices may be formed within or otherwise associated with user's 124 clothing or accessories, including a watch, armband, wristband, necklace, shirt, shoe, or the like. These devices may be configured to monitor athletic movements of a user. It is to be understood that they may detect athletic movement during user's 124 interactions with computer device 114 and/or operate independently of computer device 114 (or any other device disclosed herein). For example, one or more devices in BAN 102 may be configured to function as an all-day activity monitor that measures activity regardless of the user's proximity or interactions with computer device 114. It is to be further understood that the sensory system 302 shown in FIG. 3 and the device assembly 400 shown in FIG. 4, each of which are described in the following paragraphs, are merely illustrative examples.

i. Shoe-Mounted Device

Figure 3:
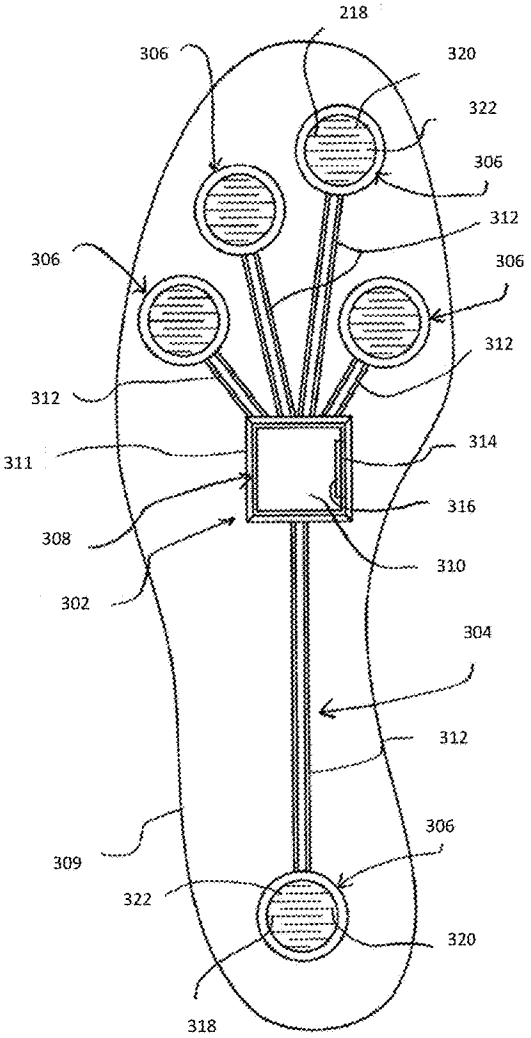
FIG. 3 shows an illustrative sensor assembly that may be worn by a user in accordance with example embodiments.

In certain embodiments, device 126 shown in FIG. 1, may comprise footwear which may include one or more sensors, including but not limited to those disclosed herein and/or known in the art. FIG. 3 illustrates one example embodiment of a sensor system 302 providing one or more sensor assemblies 304. Assembly 304 may comprise one or more sensors, such as for example, an accelerometer, gyroscope, location-determining components, force sensors and/or or any other sensor disclosed herein or known in the art. In the illustrated embodiment, assembly 304 incorporates a plurality of sensors, which may include force-sensitive resistor (FSR) sensors 306; however, other sensor(s) may be utilized. Port 308 may be positioned within a sole structure 309 of a shoe, and is generally configured for communication with one or more electronic devices. Port 308 may optionally be provided to be in communication with an electronic module 310, and the sole structure 309 may optionally include a housing 311 or other structure to receive the module 310. The sensor system 302 may also include a plurality of leads 312 connecting the FSR sensors 306 to the port 308, to enable communication with the module 310 and/or another electronic device through the port 308. Module 310 may be contained within a well or cavity in a sole structure of a shoe, and the housing 311 may be positioned within the well or cavity. In one embodiment, at least one gyroscope and at least one accelerometer are provided within a single housing, such as module 310 and/or housing 311. In at least a further embodiment, one or more sensors are provided that, when operational, are configured to provide directional information and angular rate data. The port 308 and the module 310 include complementary interfaces 314, 316 for connection and communication.

In certain embodiments, at least one force-sensitive resistor 306 shown in FIG. 3 may contain first and second electrodes or electrical contacts 318, 320 and a force-sensitive resistive material 322 disposed between the electrodes 318, 320 to electrically connect the electrodes 318, 320 together. When pressure is applied to the force-sensitive material 322, the resistivity and/or conductivity of the force-sensitive material 322 changes, which changes the electrical potential between the electrodes 318, 320. The change in resistance can be detected by the sensor system 302 to detect the force applied on the sensor 316. The force-sensitive resistive material 322 may change its resistance under pressure in a variety of ways. For example, the force-sensitive material 322 may have an internal resistance that decreases when the material is compressed. Further embodiments may utilize "volume-based resistance", which may be implemented through "smart materials." As another example, the material 322 may change the resistance by changing the degree of surface-to-surface contact, such as between two pieces of the force sensitive material 322 or between the force sensitive material 322 and one or both electrodes 318, 320. In some circumstances, this type of force-sensitive resistive behavior may be described as "contact-based resistance."

ii. Wrist-Worn Device

Figure 4:
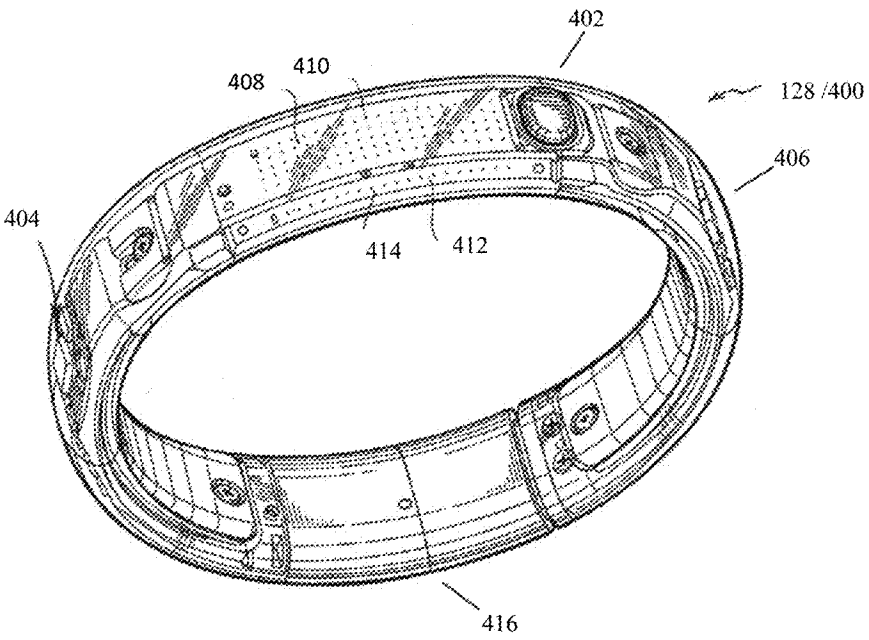
FIG. 4 shows another example sensor assembly that may be worn by a user in accordance with example embodiments.

As shown in FIG. 4, device 400 (which may resemble or comprise sensory device 128 shown in FIG. 1), may be configured to be worn by user 124, such as around a wrist, arm, ankle, neck or the like. Device 400 may include an input mechanism, such as a depressible input button 402 configured to be used during operation of the device 400. The input button 402 may be operably connected to a controller 404 and/or any other electronic components, such as one or more of the elements discussed in relation to computer device 114 shown in FIG. 1. Controller 404 may be embedded or otherwise part of housing 406. Housing 406 may be formed of one or more materials, including elastomeric components and comprise one or more displays, such as display 408. The display may be considered an illuminable portion of the device 400. The display 408 may include a series of individual lighting elements or light members such as LED lights 410. The lights may be formed in an array and operably connected to the controller 404. Device 400 may include an indicator system 412, which may also be considered a portion or component of the overall display 408. Indicator system 412 can operate and illuminate in conjunction with the display 408 (which may have pixel member 414) or completely separate from the display 408. The indicator system 412 may also include a plurality of additional lighting elements or light members, which may also take the form of LED lights in an exemplary embodiment. In certain embodiments, indicator system may provide a visual indication of goals, such as by illuminating a portion of lighting members of indicator system 412 to represent accomplishment towards one or more goals. Device 400 may be configured to display data expressed in terms of activity points or currency earned by the user based on the activity of the user, either through display 408 and/or indicator system 412.

A fastening mechanism 416 can be disengaged wherein the device 400 can be positioned around a wrist or portion of the user 124 and the fastening mechanism 416 can be subsequently placed in an engaged position. In one embodiment, fastening mechanism 416 may comprise an interface, including but not limited to a USB port, for operative interaction with computer device 114 and/or devices, such as devices 120 and/or 112. In certain embodiments, fastening member may comprise one or more magnets. In one embodiment, fastening member may be devoid of moving parts and rely entirely on magnetic forces.

In certain embodiments, device 400 may comprise a sensor assembly (not shown in FIG. 4). The sensor assembly may comprise a plurality of different sensors, including those disclosed herein and/or known in the art. In an example embodiment, the sensor assembly may comprise or permit operative connection to any sensor disclosed herein or known in the art. Device 400 and or its sensor assembly may be configured to receive data obtained from one or more external sensors.

iii. Apparel and/or Body Location Sensing

Element 130 of FIG. 1 shows an example sensory location which may be associated with a physical apparatus, such as a sensor, data acquisition unit, or other device. Yet in other embodiments, it may be a specific location of a body portion or region that is monitored, such as via an image capturing device (e.g., image capturing device 118). In certain embodiments, element 130 may comprise a sensor, such that elements 130*a* and 130*b* may be sensors integrated into apparel, such as athletic clothing. Such sensors may be placed at any desired location of the body of user 124. Sensors 130*a/b* may communicate (e.g., wirelessly) with one or more devices (including other sensors) of BAN 102, LAN 104, and/or WAN 106. In certain embodiments, passive sensing surfaces may reflect waveforms, such as infrared light, emitted by image-capturing device 118 and/or sensor 120. In one embodiment, passive sensors located on user's 124 apparel may comprise generally spherical structures made of glass or other transparent or translucent surfaces which may reflect waveforms. Different classes of apparel may be utilized in which a given class of apparel has specific sensors configured to be located proximate to a specific portion of the user's 124 body when properly worn. For example, golf apparel may include one or more sensors positioned on the apparel in a first configuration and yet soccer apparel may include one or more sensors positioned on apparel in a second configuration.

Figure 5:
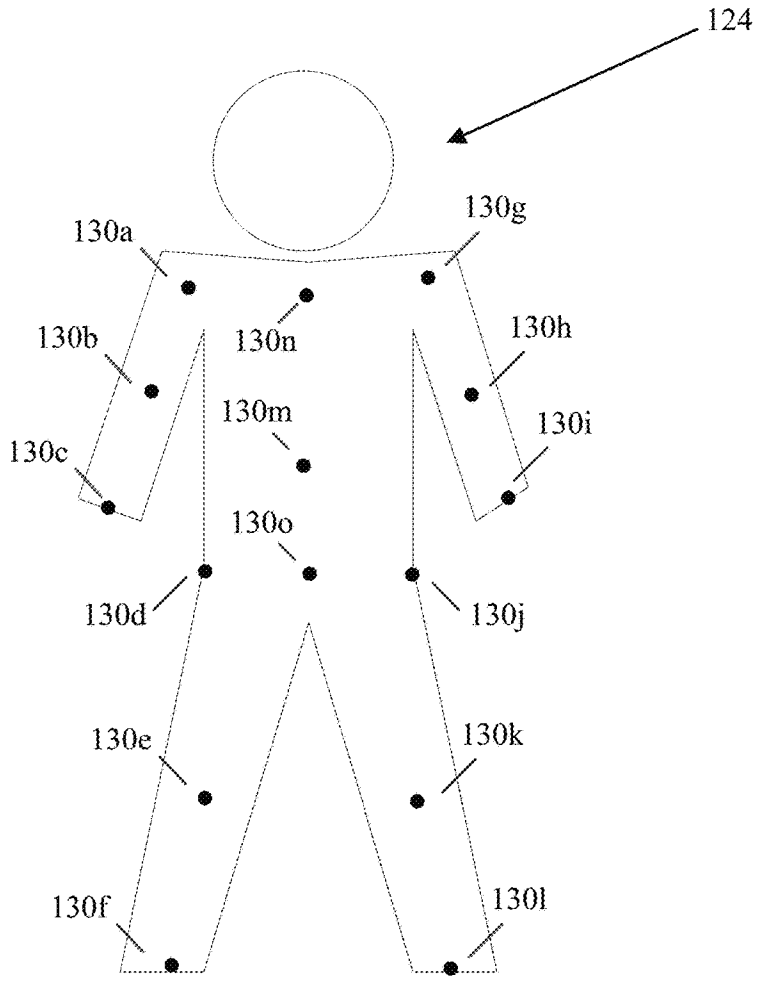
FIG. 5 shows illustrative locations for sensory input which may include physical sensors located on/in a user's clothing and/or be based upon identification of relationships between two moving body parts of the user.

FIG. 5 shows illustrative locations for sensory input (see, e.g., sensory locations 130*a*-130*o*). In this regard, sensors may be physical sensors located on/in a user's clothing, yet in other embodiments, sensor locations 130*a*-130*o* may be based upon identification of relationships between two moving body parts. For example, sensor location 130*a* may be determined by identifying motions of user 124 with an image-capturing device, such as image-capturing device 118. Thus, in certain embodiments, a sensor may not physically be located at a specific location (such as one or more of sensor locations 130*a*-130*o*), but is configured to sense properties of that location, such as with image-capturing device 118 or other sensor data gathered from other locations. In this regard, the overall shape or portion of a user's body may permit identification of certain body parts. Regardless of whether an image-capturing device is utilized and/or a physical sensor located on the user 124, and/or using data from other devices, (such as sensory system 302), device assembly 400 and/or any other device or sensor disclosed herein or known in the art is utilized, the sensors may sense a current location of a body part and/or track movement of the body part. In one embodiment, sensory data relating to location 130*m* may be utilized in a determination of the user's center of gravity (a.k.a, center of mass). For example, relationships between location 130*a* and location(s) 130*f*/130*l* with respect to one or more of location(s) 130*m*-130*o* may be utilized to determine if a user's center of gravity has been elevated along the vertical axis (such as during a jump) or if a user is attempting to "fake" a jump by bending and flexing their knees. In one embodiment, sensor location 1306*n* may be located at about the sternum of user 124. Likewise, sensor location 130*o* may be located approximate to the naval of user 124. In certain embodiments, data from sensor locations 130*m*-130*o* may be utilized (alone or in combination with other data) to determine the center of gravity for user 124. In further embodiments, relationships between multiple sensor locations, such as sensors 130*m*-130*o*, may be utilized in determining orientation of the user 124 and/or rotational forces, such as twisting of user's 124 torso. Further, one or more locations, such as location(s), may be utilized as (or approximate) a center of moment location. For example, in one embodiment, one or more of location(s) 130*m*-130*o* may serve as a point for a center of moment location of user 124. In another embodiment, one or more locations may serve as a center of moment of specific body parts or regions.

Transmitting Athletic Data

Aspects of some embodiments herein relate to using an altered discovery and/or authentication beacon to transmit sensed data. The sensed data may comprise or consist of athletic data. In one embodiment, the discovery and/or authentication beacon is configured to link or pair two devices and not transmit sensed data, however, is altered to permit the transmission of substantially real-time identification and/or athletic data without a second device that receives the beacon to be linked or otherwise paired.

Further aspects of this disclosure relate to utilizing a discovery beacon in relation to social athletic functions. In certain embodiments, embodiments may utilize a discovery authentication signal to transmit athletic data such that athletic data from a plurality of similar devices may be used. In certain embodiments, the discovery authentication signal may be used while the fitness device is a "non-connected" state, such as the device is not successfully paired with a local device while transmitting athletic data utilizing the discovery authentication signal. In yet, another embodiment, the fitness device may be operatively connected to and actively paired with at least one device, however, is still transmitting the discovery authentication signal that is detected by a second device. As such, with respect to the second device, the wireless signal comprising the discovery authentication signal is essentially performing non-connected advertising. For example, in one embodiment, a fitness device may be actively paired to a user's mobile device, such as a mobile phone, while also transmitting out a discovery authentication signal. In certain embodiments, one or more portions of the discovery authentication signal may be altered, augmented or otherwise changed.

In one embodiment, a fitness device, such as one worn or in operative communication with a user, may be wirelessly connected to a mobile device, such as a phone to transmit and/or receive electronic information, however, still advertise out the beacon to other devices. In various embodiments, this may solve problems relating to special hardware being required for hosting multiple connections simultaneously. In various embodiments, a third party may determine which of a plurality of advertised beacons to display or transmit to one or more individuals. For example, a manager of a leaderboard, a trainer, coach, or other individual may possess some control on what advertised data he/she shows and how. Thus, certain embodiments relate to a unique implementation of a non-connectable advertising data transfer system and a system of utilizing data by a third person or system. One example implementation may allow a teacher or coach showing the class or other plurality of individuals a change of work rate to one's normal work rate in doing the class or some other way to equalize individuals against one another so a plurality of individuals can attempt to try reaching a common "goal" that seems reachable by all.

Some aspects of this disclosure relate to systems and methods that allow multiple users, which may be physically proximate to each other, e.g., in a work out class, school, defined area, etc. or remote (e.g., such as virtually connected via a wired or wireless video capable link or wireless link that allows the transfer of information), to socially engage other user's during the performance of athletic activity. In certain embodiments, at least two of the users may have a fitness device capable of measuring athletic activities. One or more of the fitness devices may utilize one or more of the sensors disclosed herein. One or more of the devices may be capable of communicating over a wireless or contactless communication interface, such as an interface for Wi-Fi, Bluetooth, near-field communication, RFID, Bluetooth Low Energy, Zigbee, or other wireless communication technique, or an interface for infrared or other optical communication technique. The fitness devices may be configured to utilize a specific transmission protocol that requires pairing or otherwise authenticating at least one device in the communication pathway (e.g., Bluetooth). The fitness device(s) may be configured to transmit a discovery beacon that is configured to transmit the identification of the fitness device configured to be received by a second device, such that the beacon allows the second device detect the presence of the fitness device.

Additional aspects of this disclosure relate to aggregating athletic data. Aggregations may be based upon one or more criteria, such as ranking, proximity, sex, weight, age, athletic attributes, and/or one or more parameters. In certain embodiments, data may be aggregated from a plurality of fitness devices that are each uniquely identified with one or more users. The users may be, for example, users within a specific class, such as a spinning class, players on a team, such as a professional or amateur athletic team, or any other collection of individuals. In certain embodiments, a collection of individuals may be from a virtual class or other arrangement, wherein at least one fitness device is remote from another fitness device, such that the athletes associated with the fitness devices cannot see or hear each other without electronic assistance. In certain embodiments, athletes may be prompted or otherwise to provide authorization for data being collected within the aggregated athletic data. In certain embodiments, the authorization may be respective to a certain location (e.g., gym or playing field, and/or specific times (specific classes or games).

At least one fitness device may be uniquely associated with a user of a plurality of athletes with a leaderboard or system for aggregating and/or displaying athletic data. Unlike prior art systems and methods, there is no requirement that the athlete first disconnect their fitness device from other devices, such as switching the Bluetooth connection from their mobile phone or tablet to have information received by systems implementing leaderboard applications. In this regard, the connection status of the wireless protocol with respect to a second device is irrelevant for the leaderboard hardware application receiving athletic data from the same wireless protocol in a non-connected state. For example, a user of a plurality of users may retain or otherwise establish a direct connection with a mobile device. For example, as one example, the Bluetooth protocol only allows a single connection at a time, however, according to novel aspects; the user will not have to disconnect it to transmit data to a system implementing the leaderboard application using wireless signals. In other embodiments, the leaderboard application may be executed via a processor of the mobile device. Additionally or alternatively, the leaderboard application may be executed via a processor of the fitness device associated with the athlete. In certain embodiments, the fitness device of a user may be paired or in a connected state with a mobile device or other computing device such that the fitness device cannot be simultaneously connected with a system operating the leaderboard application, but nonetheless, the system operating the leaderboard application can receive athletic data from the same protocol from the fitness device.

In some embodiments, aggregated data may be electronically analyzed and at least a portion of the raw data and/or processed data may be displayed to the athletes. As one example, one or more fitness devices may be configured to enter a "Leaderboard" mode. In one of these embodiments, one or more fitness devices (each of which may be associated with different athletes) may be configured to have a mode in which the Fitness Device can "broadcast" a configurable set of data about a user's workout (or collection of athletic data from an event, session, game, etc. directly via a wireless protocol to a central device in a group setting during performance of the athletic activity from which the data is collected. As will be explained in more detail below, additionally or alternatively, a user may share data (e.g., athletic activity or performance data) with other users via social networking services and websites.

In some embodiments, a central device and/or remote computing device may collect data from multiple users or groups of users, such as users participating in a group activity. Alternatively, the remote system may collect data from those users that meet one or more predetermined criterion (e.g., proximity to the remote system and/or central device, authorization provided, athletic activity above a threshold, membership to a specified online community). One or more data points (either raw or processes) may be displayed to one or more users participating in the group activity, such as for example, on a "Leaderboard" for the users, instructors, and/or third parties to see. In accordance with various embodiments, the mode does not require a connection between fitness devices and the remote system operating (or hosting) a leaderboard application.

In accordance with various embodiments, athletic fitness devices may be configured in such a way that a second device (e.g. a server hosting the leaderboard) may read data from the fitness devices without establishing a connection with the fitness device. In one embodiment, the fitness device may be broadcasting the athlete's athletic activity data while the second device is configured to listen for this broadcast from a plurality of devices, which may be based upon one or more criterion. In certain embodiments, all the data necessary for an expected user experience may be broadcasted directly from their associated fitness device to the second device (e.g., a server hosting the leaderboard).

Activity Monitoring Using a Mobile or Other Fitness Device

Various software (e.g., athletic display module) and hardware (e.g., athletic information collection, display, and fitness devices) may be used to track athletic activity and provide such information to an individual. In one arrangement, the software and/or hardware may be included in a mobile device such as a mobile communication device or mobile computing device. Use of a mobile device for detecting, collecting, processing and display of athletic information may provide an athlete with athletic activity information in a variety of environments. For example, to view processed or collected athletic activity information, the athlete may use his or her mobile device instead of having to use a stationary computing system. Such mobile devices may include smartphones, mobile telephones, personal data assistants (PDAs), laptop computing devices, digital music players, tablet computers, wrist worn devices, and the like. Computer executable instructions in the form of a software application or applet may be stored in the mobile device, allowing the mobile device to perform various athletic activity tracking and monitoring functions. For example, the mobile device may offer feedback, challenges, suggestions, encouragement and other data in response to an individual's athletic performance. In one example, the computing device may challenge the individual to perform a more strenuous or more difficult workout than in a previous workout session in order to help the individual improve and achieve greater progress. By achieving more substantial progress, the individual may be more motivated to continue exercising on a regular basis. In another example, the mobile device may be configured to encourage and motivate the individual based on his or her performance and/or comments and encouragement received from other individuals.

Figure 6:
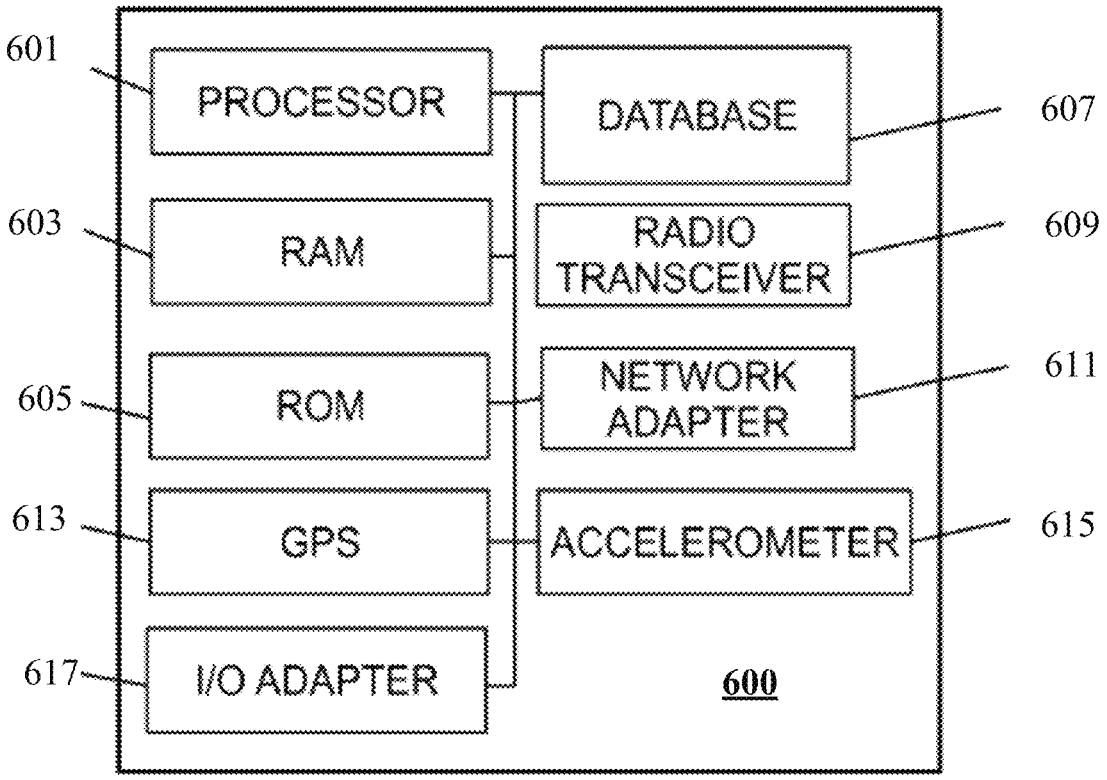
FIG. 6 illustrates an example mobile athletic activity monitoring device according to one or more aspects described herein.

FIG. 6 illustrates a block diagram of an example mobile device that may be used to track athletic activity information and provide various types of feedback to an individual. Mobile device 600 may include processor 601, RAM 603, ROM 605, database 607, radio transceiver 609, network adapter 611, global positioning system (GPS) device 613, accelerometer 615 and I/O adapter 617. Computer readable media such as RAM 603 and ROM 603 may be configured to store computer readable instructions that, when executed, cause an apparatus such as mobile device 600 to perform one or more functions described herein. Processor 601 may be configured to perform various calculations and execute instructions stored in RAM 603 and ROM 605. Database 607 may provide storage for data including user information, phone numbers, network addresses, e-mail addresses, software, images, documents and the like. I/O adapter 617 may be configured to facilitate the reception and output of data to one or more input or output devices including a touchscreen display, a speaker, audio jack, physical keyboard, microphone and the like.

The inclusion of GPS device 613 and accelerometer 615 in a single mobile device 600 allows device 600 to record athletic activity data in multiple workout settings. For example, if an individual is running on a treadmill, GPS device 613 would likely be unable to detect or provide significant exercise data since the individual generally remains stationary and a GPS satellite signal may be unavailable. As such, the mobile device may instead use the accelerometer to determine a number of steps the individual has taken, a speed/acceleration (e.g., pace) of the individual and the like. If, on the other hand, the individual is running outdoors such that the individual moves from one location to another, the GPS device 613 or recording of data therefrom (e.g., GPS device is always active, but recording is turned on and off) may be activated and used instead. In one or more arrangements, mobile device 600 may automatically detect whether GPS device 613 should be used or accelerometer 615 should be used (or whether data should be recorded from GPS device 613 or accelerometer 615). For example, if device 600 determines that the individual's location is not changing, accelerometer 615 or recording data therefrom may be activated and used (again, the device might always be active, but recording data from the device is turned on and off). In some arrangements, both GPS device 613 and accelerometer 615 may be used in conjunction with one another to provide additional data granularity and/or to enhance accuracy of the data. Other sensors may also be included in mobile device 600 including a heart rate monitoring device to provide additional types of activity data. Additionally, in some instances, location may be determined using cellular triangulation if GPS is unavailable.

In one or more arrangements, mobile device 600 may automatically switch between a GPS without accelerometer setting, an accelerometer without GPS setting or a combination GPS and accelerometer setting (and in some cases, a cellular triangulation with accelerometer mode). The switching and determination of which mode to use may depend on a variety of factors including detected movement, GPS signal strength and availability, user preferences, location and the like. For example, if a GPS signal is low (e.g., below 50% strength, below 30% strength, below 10% strength, etc.), mobile device 600 may operate (e.g., record data from) both GPS device 613 and accelerometer 615 so that the accelerometer 615 data may supplement any potentially missing or inaccurate GPS information. Alternatively or additionally, GPS data and accelerometer data may be averaged or otherwise combined to determine an amount of athletic activity performed by the user. In another example, mobile device 600 may use and record data from the GPS device 613 without using or recording data from accelerometer 615 when the signal strength is above a predetermined level (e.g., 50%, 70%, 90%, etc.). In yet another example, if mobile device 600 detects movement via accelerometer 615 but does not detect change in position using GPS device 613, mobile device 600 may use accelerometer 615 without GPS device 613 for that workout. Further, if the device 600 begins detecting a GPS signal, device 600 may switch to GPS mode or a combination GPS/accelerometer mode. In other instances, an accelerometer 615 may be used without GPS device 613 if no GPS signal is available and/or a location of the user is indoors. The user location may automatically be determined using GPS (e.g., location, signal strength) or based on manual input.

According to one or more arrangements, mobile device 600 may determine that a user is performing stationary athletic activity by detecting steps taken at a predefined pace, receiving user indication of a start of athletic activity, detecting elevation of heart rate (e.g., through a heart rate sensor) and the like. In one example, the mobile device 600 may detect steps being taken above a threshold pace using data from the accelerometer 615. Upon detecting the steps being taken, the mobile device 600 may determine whether GPS data from GPS device 613 is available and/or indicates a change in location. If not (e.g., no GPS signal or no change in location), the mobile device 600 may register that the user is performing a stationary athletic activity. The mobile device 600 may further confirm this determination with the user. Additionally or alternatively, mobile device 600 may also determine whether an elevated heart rate is detected.

In other examples, other sensors may be used in concert with a location determination system to provide alternative or additional activity information. For example, a heart rate sensor may be used to determine whether the user is performing athletic activity if a location determination system does not detect a change in a user's physical location (or a change above a predefined threshold distance or altitude). Additionally or alternatively, GPS device 613 and/or accelerometer 615 may be physically separate devices from mobile device 600. For example, accelerometer 615 may correspond to a wrist-worn or shoe-integrated sensor. GPS device 613, for instance, may be incorporated in a wrist-worn device. Mobile device 600 may communicate and receive data from each of these separate devices using various wireless or wired communication systems including BLUETOOTH, Wi-Fi, infrared and the like.

Mobile device 600 or other computing systems may offer a variety of functions and options for defining a workout. For example, the system may offer the user options of starting a run from scratch or improving on a previously completed run. The run may then be customized and encouragement and/or status information may be provided to the individual before, during and after a run or other athletic performance.

Using an athletic activity monitoring device such as device 600 of FIG. 6, a user may register athletic activity sessions and record data therefrom. Registration of an athletic activity session may include defining the type of activity, a duration of the activity, audio, video or haptic feedback to be provided and the like. This information may be entered through one or more applications execution on device 600 or some other fitness monitoring device as described herein. Accordingly, the user may set-up an athletic activity session in a mobile environment and shortly before engaging in the activity session.

In some embodiments, a user may define an athletic performance or activity (e.g., a run) and associated activity goals therewith using a mobile device such as device 600 of FIG. 6 or other fitness monitoring device. In one exemplary process, a system may receive user input corresponding to a command to initiate a workout or other athletic activity. In this example, the user input may comprise user selection of a workout option from a menu of applications or functions available on the system. The system may subsequently offer the user multiple workout options in response to the command. For example, the system may provide options for repeating a last run, starting a basic run, improving on a past run, calibrating one or more sensing devices, viewing a workout history and/or setting a goal. The options may be categorized and displayed in separate sections or screens of a user interface. Various other options may be presented to the user for defining the workout or athletic activity. For example, a home screen may include a repeat last run option, a get better option and a basic run option while a workout screen may include the basic run option, the get better option, a goal setting option, a history option and a calibration option.

If the user chooses a repeat last run option, the user's most recent run may be retrieved from a database. This database may be local to the system or may be resident in a remote server. The system may then make a determination as to where the run took place, e.g., outdoors or indoors, since the location of the run may determine what sensors are used in tracking the activity. For example, if the previous run occurred outdoors, the system may initiate a run to be tracked and monitored using a GPS device. On the other hand, if the run occurred indoors, the system may initiate a run to be tracked and monitored using an accelerometer system. Initiation of the run may include activation of the relevant firmware, hardware and/or software, defining workout parameters (e.g., setting a calorie burning goal for indoors versus a distance goal for outdoors), generating a workout interface (e.g., a gym image for indoor runs and outdoor scenery for outdoor runs) and the like. As noted herein, in some arrangements, both accelerometer and GPS systems may be used to track various workout statistics if the workout allows for the use of GPS while only non-GPS devices may be used for indoor workouts. Using a device may include recording data from that device and instructing the device to communicate data at specified times (or continuously). Repeating a last run may also include using the same music playlist or other audio content as the previous run. Alternatively or additionally, the user may be provided with an option and opportunity to customize the audio content for the current run.

If the user chooses to improve his or her workout performance, the user may be presented a second set of options. The options may offer various methods of improvement including running a specific route, running faster, running longer, running farther, setting a personal best (time-wise) in the 1K or 5K, or setting a personal best in a distance run. If the user selects an option to complete a particular route, the user may be presented with a route list. The route list may include routes previously run and/or saved by the user, routes downloaded from a remote network site, routes run by friends or other acquaintances and the like. In some arrangements, the routes may be recommended to the user based on the user's past athletic performances including types of routes previously run. For example, the user previously ran 3 miles on substantially flat terrain, the mobile device or another system may identify a similarly distanced route having a similar terrain. In some arrangements, the recommended routes may include routes seeking to challenge the user. For example, the recommendations may include 3.5 and 4 mile routes or routes that have a more significant hill profile to help the user improve.

If, on the other hand, the user selects one of the other options, the user may be asked to input a corresponding improvement amount. The system may subsequently set the goal for the workout based on the user input received via the mobile device (and/or fitness monitoring device). The amount by which the user wants to improve his or her performance may be defined in terms of percentages or absolute values. For example, if the user wishes to run farther, the user may define the number of additional miles he wishes to run or a percentage increase in the number of miles. The total number of miles may then calculated based on a most recent run or based on a personal best depending on the type of improvement selected. In one example, if a user selects the option to run farther, the improvement goal may be defined based on the user's last run. If, however, the user selects the option to set a personal best in distance run, the improvement goal may be automatically, semi-automatically and/or manually defined based on a previous or current personal best in distance. For example, the system may automatically set the goal as a certain percentage (e.g., 5%) above the user's personal best in distance. Alternatively or additionally, the user may be given the option of selecting the workout from which he would like to improve from all previously recorded workouts.

If the user chooses a goal setting option from a workout menu, the user may be asked to select a type of goal he would like to set. The various types of goals may include distance, time, and calories. Other types of goals may also be set such a pace, heart rate, percentage incline run and the like. In one or more arrangements, the user may select more than on goal type so set multiple goal parameters for the run. Upon selecting the type of goal, the system may display a list of goals to the user. The list of goals may include one or more predefined and/or automatically defined goals such as run a marathon, run for a specified time (e.g., 30 minutes) and/or burn a certain number of calories (e.g., 300 calories). The list of goals may also provide an option for the user to customize the goal. For example, if no predefined selection is available for running 10 miles, the user may set a customized goal for running 10 miles. In another example, if the user wishes to burn 500 calories, but the predefined calorie goals are in 200 calorie increments, the user may set a customized 500 calorie goal instead of being forced to choose either 400 or 600 calories.

As will be explained in more detail below, once a user has selected a workout type and/or defined a goal for the workout type, the system may determine whether the user wishes to publish workout information on a social networking site such as TWITTER, FACEBOOK, and the like. Alternatively or additionally, the system may determine whether the user wishes to synchronize workout data to an athletic activity monitoring service. If so, the user may be prompted to enter various identification or login information so that the system may automatically access the user's account and synchronize or post information thereto. The user may also be prompted to enter publishing or synchronization options including whether the information is to be made available to the general public, a select group of friends or users, whether all data is to be synchronized or just a particular type of data (e.g., calories, distance run, route, etc.) and the like.

Other athletic activity session setting options may also be provided in the process. For example, the settings may allow an athlete to specify whether to post the performance information to a social networking site or a news feed, whether to synchronize or sending data to an athletic activity performance monitoring service and the like.

Figure 7B:
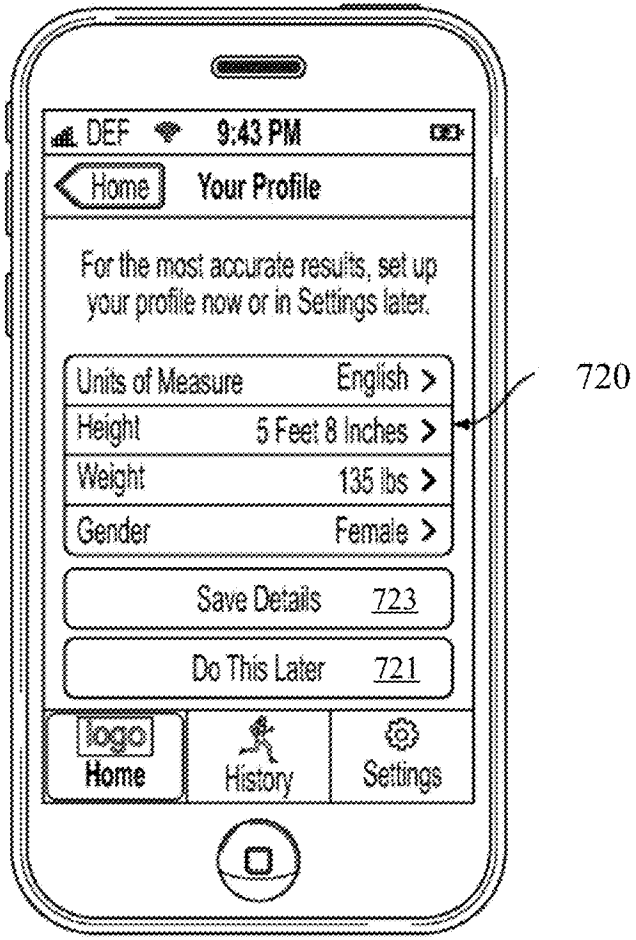
FIGS. 7A and 7B illustrate user interfaces that may be generated and displayed when an individual defines and/or begins an athletic activity according to one or more aspects described herein.
Figure 7A:
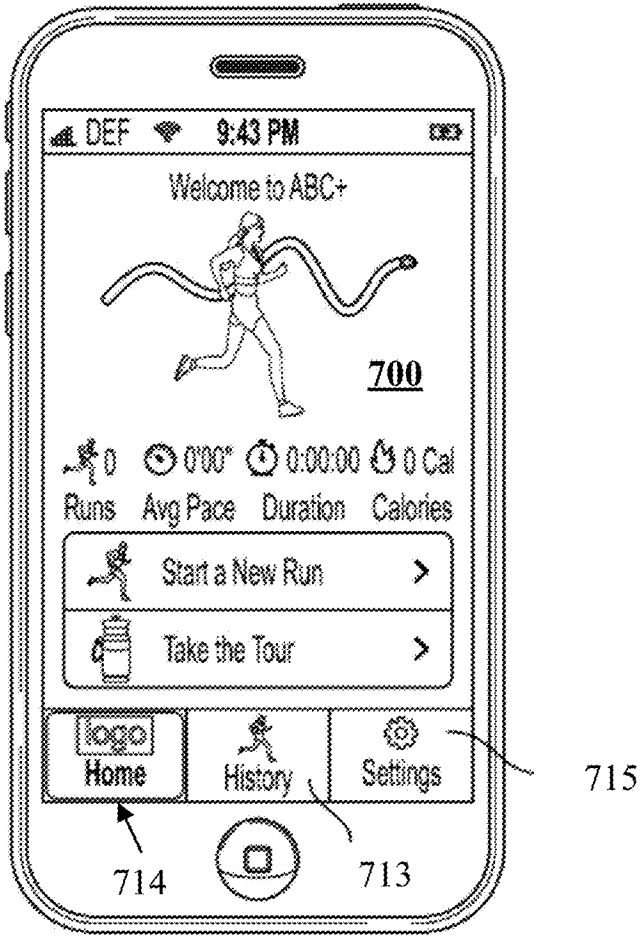
Figure 10A:
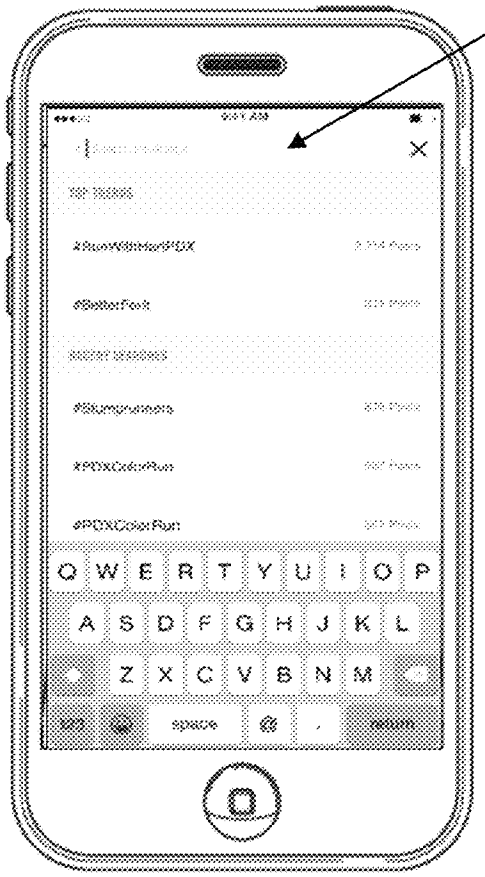
FIGS. 10A-10C depict example search interfaces in accordance with one or more aspects disclosed herein.

As shown in FIG. 7A, interface 700 may display user and workout information including a number of previous runs (e.g., 0 since the user does not have any previously recorded runs), average pace, duration and calories burned. Duration and calories burned measurements may be a total duration and total calories burned, respectively, across all runs performed or may be an average for each run. Interface 700 may further display multiple options including an option to start a new run and an option to tour the features of the workout application. Additionally or alternatively, interface 700 may include options for accessing other aspects of the workout application including history option 713 for display a list of previously recorded workouts and settings option. Selection of settings option may cause a profile setup/edit interface to be displayed. In one arrangement, selecting new run option may also cause a profile setup/editing interface to be displayed if the user has no previous run history As noted above, a user may be provided with various interfaces and options for defining athletic activities, activity goals, and associated activity parameters as shown in FIG. 7A. FIG. 7B illustrates a profile setup/editing interface 720 through which a user may configure various workout and workout recordation parameters. For example, interface 720 may allow the user to define the units of measure to use and to set the user's height, weight and gender. The profile setup/editing interface 720 may be displayed upon the user selecting the option to start a new run session (as shown in FIG. 7A) and/or the user choosing settings options 715 (FIG. 10A). Additional or alternative parameters may be changeable through interface 720. The user may be provided with an option 721 to skip a profile setup/editing function. If the user chooses to complete the profile setup, the user may save the profile information using option 723. A user may navigate to other interfaces and screens such as home screen 700 (FIG. 7A) by selecting home navigation option 714.

Once the user has completed setting up their profile or upon the user choosing to skip the profile definition menu, the user may be presented with a run setup interface. The run setup interface may be configured to allow a user to define workout parameters for the new run. For example, the user may define the run type, the music that is to be played during the workout and the location, each of which are described in further detail herein. Once these parameters have been defined, the user may begin the run or other athletic activity.

In some embodiments, the user may be presented with an in-run interface, wherein a current distance run and/or other performance data may be displayed to the user. Other information such pace, split times, an amount of time spent in the workout and the like may be presented to the user. The user may also be provided with options for controlling the playing of audio content, changing the audio content being played, and ending the workout.

In other embodiments, the user may be presented with a workout summary upon completion or ending of the athletic activity (e.g., run). For example, the summary may include includes a total distance run, pace, time spent running and calories burned. The summary interface may further display an option for displaying a route that the user run if the run was recorded using a GPS device. Other options may include an option to tag the run with the user's emotional or mental state (e.g., a mood), an option to share athletic activity data with other athletes or groups of athletes, and/or an option to visit an athletic activity service provider site.

Tagging may involve storing metadata, attribute or other type of information in association the one or more parameters or metrics of the activity data. Other or additional tags may also be used including a tag identifying athletic equipment (e.g., shoe) used during the workout and a tag specifying the weather during the workout. By tagging a workout with the athletic equipment used, a system may monitor the wear on the athletic equipment and recommend replacement upon reaching a threshold amount of wear or user (e.g., an amount of athletic activity performed using the athletic equipment). In one example, wear or amount of user/athletic activity performed may be measured by a distance run and the athletic equipment may include a shoe. In other examples, an amount of athletic activity performed may be determined based on calories burned and/or pace. Tagging athletic equipment might also provide insight (e.g., tracking) of how and where products are used, expected product life times, popularity (e.g., specific to different sports) and the like. Accordingly, an athletic activity monitoring service or product provider may use this information to better target, develop and/or improve products. Visiting the athletic activity service provider site may allow the user to view additional workout information that has been collected by the service provider for the user. This may allow the mobile device to minimize the amount of storage necessary in the mobile device, instead storing workout data in the service provider site.

Additionally or alternatively, a welcome or home interface such as interface 700 of FIG. 7A may further include a feedback option providing the user with the ability to activate or deactivate feedback for his or her workout. Feedback may include audio, video or haptic feedback and may originate from other athletes, friends, celebrities, family, service providers (e.g., an athletic training and monitoring service) and the like. In some examples, the feedback may comprise audio, video or haptic content that is configured to be delivered during a workout upon the user achieving a certain goal or reaching a specified threshold. Feedback may also be provided post-workout if the user achieves a certain goal or reaches a threshold. In other examples, feedback may be provided based on other triggering events such as a number of comments received from others through social networking outlets such as FACEBOOK and TWITTER. The feedback option may also include various levels of granularity to allow a user to select sources of feedback that are desired and sources of feedback that are not desired during the workout. Additional feedback options may include whether audio being playing during the workout is to be paused during the feedback.

Feedback may be congratulatory, encouraging or motivating. For example, if the user accomplishes a certain goal, the feedback messages may be congratulatory. In some examples, if a user is not on track to meet a goal, the message may be motivating or encouraging. Feedback may also include suggestions for improvement. Accordingly, the type of message that is provided to the user may depend on a result or current status of a user's workout. The monitoring device or system may be configured to automatically select an appropriate type of message depending on the workout result or status.

In one or more examples, setting up a workout may include adding or defining desired coaching. Coaching may represent a type of feedback that is intended to be instructional, regimented and structured and to be provided prior to, during or after the workout and may be event-specific and/or user-specific. For example, coaching may provide instructions that are specific to a marathon if a user has selected a marathon as the type of workout event. In another example, coaching may provide specific instructions for interval training (e.g., run, slow to a first pace, accelerate to a second pace, cool down, warm up, etc.). The intervals may be defined based on user attributes including height, weight, gender, workout history and the like. Accordingly, the instructions may be cued time-wise or distance-wise based on the user-specific intervals or other event-specific actions to be taken. Appropriate coaching (e.g., instructions) may be selected upon a user defining a desired run, which may include selecting a desired run type, distance, pace and the like. Coaching may further include tips or advice provided to the user before a workout, during a workout and/or post-workout and may be provided audibly, visually and/or haptically. For example, instructions may be indicated through use of vibrations, visual indicators or audio tones or vocal instructions.

Coaching may also be specific to a particular location or time of day. For example, coaching may include recommendations for improving incline running if a given location has a more significant hill profile (e.g., San Francisco). In another example, coaching may recommend less strenuous workouts early in the day or later in the day depending on metabolic cycles, user preferences, meal times and the like. In still other examples, coaching may provide recommendations on how fast to run (e.g., a pace) for various types of terrain and/or during different types of weather conditions. Once a user has completed a first run, the application may provide different user interfaces reflecting the recorded workout history.

If a history option is selected, e.g., option 713 as shown in FIG. 7A, the user may be presented with a listing of recorded runs. The user may then select from one of the previously recorded run to improve. For example, the user may elect to improve upon a previous 14.7 mi run by 5%. Upon selecting the previously recorded 14.7 mile run, the user may be presented with an interface in which the user may select a statistic or metric recorded in the 14.7 mile on which to improve. The system and application may automatically calculate the objectives with the improvement amounts added. For example, a user may select options to run farther, run for longer amounts of time and run at a faster pace.

In one or more arrangements, the fitness (or mobile) device may further generate coaching based on defined activity parameters. In one example, the coaching may advise the user to warm-up for a longer period of time if an intended athletic activity (e.g., run is a longer distance (e.g., 10 miles) than if the run was a shorter distance (e.g., 3 miles). Alternatively or additionally, different warm-up activities may be recommended depending on a desired pace or distance. The coaching may be provided as audio from an athlete or celebrity. In a particular example, a user may select a celebrity or well-known coach. Each coach may correspond to a different level of training difficulty and aggressiveness. For example, one coach may challenge the user to exceed his or her defined goal by 10% (e.g., by cuing the user to run faster than an average pace during the workout). Other coaches may challenge the user to exceed his or her defined goal by 30% (e.g., by cuing the user to run faster than an average pace more times and/or for longer durations during the workout). Some coaches may correspond to different types of workouts. For example, a coach may prefer interval training while another coach may prefer short sprints to longer, slower runs.

Additionally, tips and advice provided to the user may further include a recommendation for athletic equipment, footwear, athletic services and other products. For example, upon determining that the user is planning a new workout, the device may recommend purchasing a new pair of shoes if the user's current shoes are reaching a threshold wear state. The device may also recommend various types of apparel such as compression socks, leggings, t-shirts, shorts, pants and the like, windbreakers for windy areas, thermal underwear for colder locations, headbands or sweatbands in hotter climates and the like.

According to one or more aspects, the product recommendations may be generated based on user descriptions of previous workouts. For example, if a user indicated that a workout was tiring, the device may recommend purchasing a sports drink prior to beginning the next workout. In another example, the weather or terrain specified in a previous workout or workouts may affect the type of product recommended. For example, one type of shoe may be recommended for road running while another type of shoe may be recommended for track running. In still another example, moisture wicking apparel may be recommended for warmer climates while thermal apparel may be recommended for colder climates.

Various other types of recommendations and recommendation factors may be used in conjunction with the aspects described herein. For example, recommended products may be digital or service-related. In particular, the device may recommend visiting a route mapping application or service upon completion of the run to allow the user to better visualize the various attributes of the run relative to a geographic map of the route. In another example, coaching or other types of tips and information may include location-specific advice. If the mobile (or fitness) device detects that the user is about to embark on a particular route, the device may provide advice regarding the various terrains along that route. In a particular example, the device may provide coaching (e.g., how fast to run, where to run slower or faster, how much energy to expend during certain portions of the route) depending on location-specific information or attributes including terrain, weather, inclines, elevations and the like. The location may be detected, as described herein, using GPS devices or by manually identifying a location using coordinates, zip codes, area codes, city names and/or combinations thereof. Other types of location information may include a number of users running in a particular area (region of country, world, particular route, city, state, zip code, area code, etc.). Location-specific information may also be provided during the workout as the user reaches or comes within a predefined amount of distance of a location.

As noted above, after a user completes his or her run, the user may be presented with a workout summary. Additionally, the device may select, generate and/or display words of encouragement or indications that the user has reached a goal or milestone. For example, a user may receive accolades or motivational messages when the user has recorded his or her longest run (duration or distance) or fastest run (e.g., for a 1K, 10K or other predefined distance). The message may be textual in nature, include audio output, provide haptic feedback and/or combinations thereof. Workout summaries may include different information or options depending on the location of the workout (e.g., indoors or outdoors). For example, a workout summary for an indoor workout may include a calibration function to insure accuracy of the data recorded while an outdoor workout summary might not include the calibration function. The difference in workout summary functionality may be attributable to the accuracy with which a GPS device is able to track distance and/or pace.

In some embodiments, the user may be presented with a user interfaces through which a user may tag a run based with various types of information and parameters, including location-specific attributes. For example, a user may specify how he or she felt after the run by choosing a mood indicator presented on the user interface. As another example, the user may associate specific weather conditions with an athletic activity by choosing various weather options presented via the interface. As yet another example, the user may associate a terrain type with the activity by selecting a terrain option, and may further enter notes relating to the user's athletic performance. Weather may be tagged automatically in some instances using GPS functionality. That is, a mobile device may automatically retrieve the weather of a given location detected using a GPS device and tag the workout using the retrieved weather data. The terrain option may include exercise equipment such as a treadmill, outdoor terrains such as straight road, a dirt path, a winding road and the like. Terrain might also be automatically registered based on the GPS information received. In some instances, the user might not be required to enter any of the tags. While some of the tags may be automatically registered or inputted, the user may be allowed to edit the entries. Thus, the user may tag one, two, or all of the presented tagging options as he or she desires.

Other tags may also be used and users may define their own customized tags as well. For example, a user may be allowed to select an athletic equipment tag to indicate the type of athletic equipment used or worn during the workout. As another example, a user may be allowed to select a footwear tag to indicate the footwear worn during the workout. In a particular example, the user may identify a type of shoe or specific pair of shoes worn during a run. Specific shoes may be defined by the user and stored to the device or a remote system. The tagging of athletic equipment and/or footwear may allow the application, device or remote system to track wear or use (e.g., an amount of athletic activity performed) of the athletic equipment and/or footwear among other information. When the wear reaches a certain threshold (e.g., a number of miles or workouts), the device may alert the user that replacement is recommended. The device may also recommend replacement equipment based on, for example, the user's current type of shoe and/or other athletic equipment, height, weight, gender, shoe size, gait characteristics and the like. Recommendations may be made at any time and are not limited to replacement conditions. For example, a system may provide recommendations when a new product comes out that matches or is determined to be suitable for the user based on current or past athletic equipment, footwear, activities performed, terrain on which the user frequency runs, common weather conditions and the like.

Additionally or alternatively, a user may tag a workout with one or more devices (e.g., sensors, music devices, athletic activity data collection devices, etc.) used during the session. For example, a user may identify that a GPS device was used and/or that a heart rate sensor or an accelerometer was used. In some arrangements, the devices used during the workout may be automatically registered in a tagging menu. The user may then edit the automatically populated devices as desired or necessary.

A monitoring and training application may further provide an ability for the user to tag or otherwise register friends or other individuals associated with a workout session. As such, if a user performed a run with a friend, the user may tag the run with the friend's information. In a particular example, the user may select a username or other identifier associated with the friend in a tagging menu of the application. The username or identifier may correspond to an identifier registered with an athletic tracking and monitoring service, a social networking site, a phone number, a nickname specified in a user's phonebook or the like. Multiple friends or workout partners may be tagged to a single workout session as appropriate. In some arrangements, the device may automatically tag the workout session with known individuals running the same route at the same time. The device might only tag the workout session with individuals that have a confirmed relationship with the user. For example, only individuals that have mutually confirmed a relationship with one another may be tagged in each other's workout sessions.

The use of tags may enable the user to sort by one or more of the tagged parameters. The user may thus limit his or her view of workout history and other workout related information to a desired set based on the one or more filtering parameters such as weather, type of device used, workout partners, equipment used and the like.

Sharing Athletic Performance Information

Figure 8:
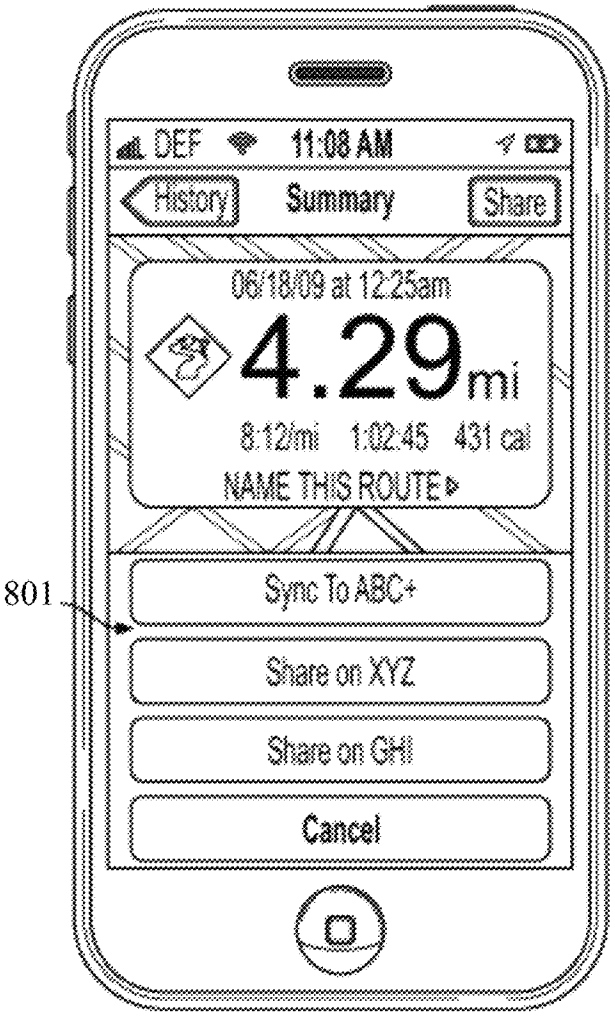
FIG. 8 shows an example interface for sharing athletic performance data between multiple users.

In some aspects of the disclosure herein, users may choose to share workout information or portions thereof with one or more other users, friends or through a social networking site. As shown in FIG. 8A, the user may be presented with a share menu 801 that includes multiple sharing outlets including FACEBOOK and TWITTER. Menu 901 may also include an option to synchronize workout information with a fitness monitoring service provider.

If the user chooses to share workout data through a social network site such as FACEBOOK, a new interface may be displayed. This interface may include a configurable, automatically generated workout update message, and may allow the user to include additional information or notes along with the message. Upon approving the message, the user may publish the data to the social networking site by selecting a publish option on the interface.

Sharing workout data through a news feed or other social networking service (e.g., TWITTER) may be performed through an interface presented to the user. This interface may require a user's login and password information to automatically access the news feed service or other social networking service. The login information may be stored and used in association with a fitness monitoring service provider to synchronize and publish data automatically to the information outlet. Once the user is logged in, the system may automatically share new run information through the information outlet. In some arrangements, the information might only be shared in response to receiving a user command or confirmation. The news feed message may be an automatically generated message that includes workout and/or route information. The user may be allowed to edit the message and/or create his or her message.

Figure 9:
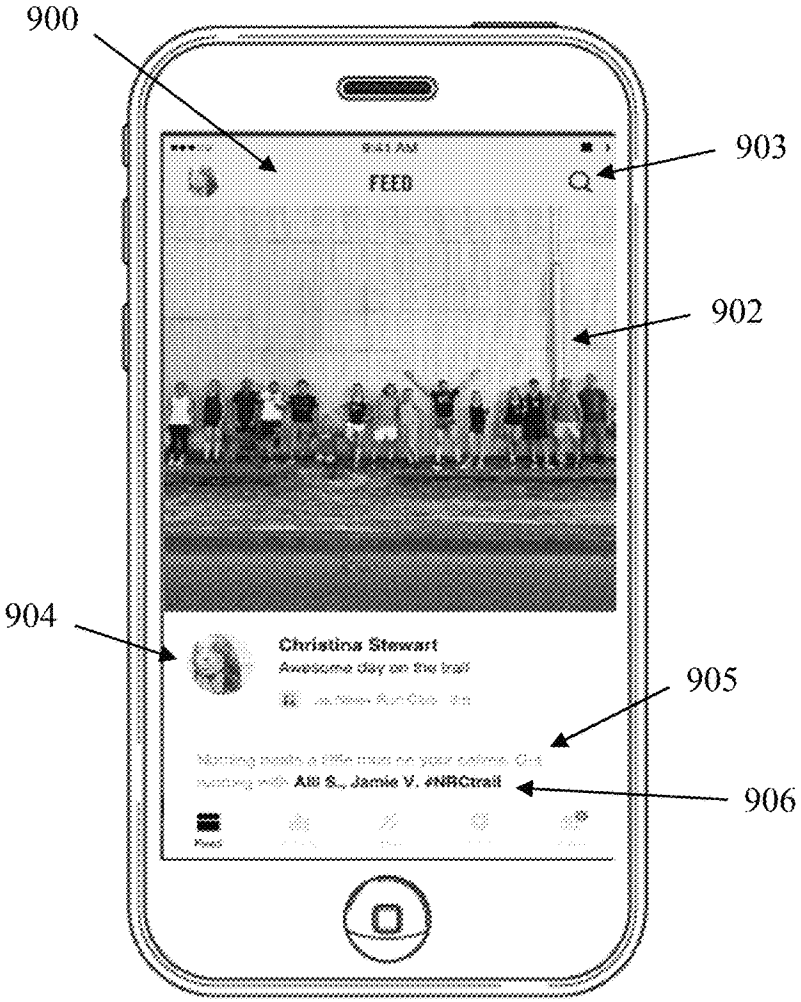
FIG. 9 depicts an example interface for displaying user posts within an activity feed.

FIGS. 9 and 11A-11H illustrate an exemplary user interfaces through which activity information and events may be conveyed and viewed. For example, FIG. 9 illustrates a portion of an activity feed that displays activity levels and other data such as activity achievements for users within an online community (e.g., whether the goal was completed or missed, streaks, milestones, records, etc.), tags and the like in a list format organized according to activity time period (e.g., day). The activity feed may provide a way for a user to digest activity information for multiple users performing a plurality of activity over varying time periods through a single interface or display. In some arrangements, the user may configure the types of information that are included in the activity feed based on their specific interests.

As shown in FIG. 9, users may post or share pictures and images, such as an image of the user performing an athletic activity (i.e., image 902). In some embodiments, each post displayed in the activity feed interface 900 may display information associated with the user that created the post, such as location information, a communication/message, user name or nickname, an image of the user, and the like. For example, portion 904 of activity feed interface 900 shown in FIG. 9A displays an image of the user, username, and message associated with image 902 that was posted by the user. As noted above, the user may also include a message or other notes with their post. For example, as shown in portion 906 of interface 900, the user may publish a message (or other notes) to be included with a post. In still other embodiments of the present disclosure, the user may tag or otherwise associate various parameters, notes, activity data, other users, and the like with an activity post.

The tags, notes and/or parameters, in some instances, may be included in a message associated with an activity post. The system may analyze a message includes with a post and automatically detect whether certain parameters, activity data, and/or other users are associated with a particular post. Interface 900 may provide an ability for the user to tag or otherwise register friends or other individuals associated with a workout session and/or corresponding activity post. As such, if a user performed an athletic activity with a friend, the user may tag the friend and/or the friend's activity information to the post. In a particular example, the user may select a username or other identifier associated with the friend in a tagging menu of the interface. The username or identifier may correspond to an identifier registered with an athletic tracking and monitoring service, a social networking site, a phone number, a nickname specified in a user's phonebook or the like. For example, as shown in portion 906 of interface 900, the user may tag or register other friends and users (e.g., "Alli S." and "Jamie V") that participated in and/or are associated with one or more activities corresponding to the post displayed in the interface.

Multiple friends or workout partners may be tagged to a single post or corresponding message as appropriate. In some arrangements, the device may automatically tag the workout session with known individuals running the same route at the same time. The device might only tag the activity post with individuals that have a confirmed relationship with the user. For example, only individuals that have mutually confirmed a relationship with one another may be tagged in each other's workout sessions. In other aspects of the present disclosure, weather, performance data, terrain, elevation, body temperature, other users and the like may be automatically registered as a parameter or tagged parameter of a post based on information that is determined through the mobile or fitness device, such as a GPS receiver, heart rate monitor, gyroscopes, accelerometers, thermometers and the like. In other embodiments, the user may be provided with one or more menus, icons, interface elements, and the like that permit the user to manually identify the particular, parameters, activity data, users, and other information to associate with the post.

After a first user publishes a post on a social networking site or other online networking service, the post may become visible to other users or groups of users via their respective activity feeds. In some embodiments, the post may become visible to a predetermined group of users, wherein the group is configurable by the first user. Other users may subsequently publish messages and/or comments in response to the original post authored by the first user. Alternatively or additionally, cheers, words of encouragement and/or other messages may be provided other users in response to the post that was published by the first user. These messages may include audio, video, images, animated images and the like. The use of tags may enable the user to sort by one or more of the tagged parameters. The user may thus limit his or her view of activity post and other related activity information to a desired set based on the one or more filtering parameters such as weather, type of device used, workout partners, equipment used, metatags (e.g., hashtags) and the like.

In some aspects of the present disclosure, a user may include a hashtag (or other metadata tag) in the message of a post such that the user may tag (and/or associate) an athletic activity, performance data, workout session and the like with the post. For simplicity purposes for the reader, many examples are described in relation to example hashtags, however, the disclosure should not be limited to example metatags unless otherwise stated. The hashtag may be utilized as an identifier to build competition and provide challenges to groups of users. For example, after performing a run or some other athletic activity, a monitoring device may record activity data for the user during the athletic performance. As noted above, the user may share a message, pictures, workout information and/or performance data with other users via a social networking service. The user may generate a post that includes a picture, a message and/or other information associated with an event (e.g., the recent athletic performance). A user can include a hashtag in the message of the post to uniquely identify the post and/or the performance data associated with the post. The user may further choose to link the authored post with the activity information and performance data associated with the event (e.g., the recent athletic performance). After drafting the post and including any desired information to include with the post (e.g., pictures, weather, other users, etc.), the user may publish the post to an activity feed.

After a first user's post has been published to an activity feed, other users having access to the post via their respective activity feed may select one or more hashtags included in the message of a user's post. In some aspects of the present disclosure, a hashtag included in the message of a user post may be interactive. For example, by selecting a hashtag, a user may be directed to a predetermined interface and/or webpage. As another example, in response to a first user selecting a hashtag included in the post of another user, the system may direct the first user to another interface that provides a plurality of posts associated with and/or corresponding to the selected hashtag. In other aspects of the present disclosure, a user may be prohibited from selecting a hashtag included within a post if the user does not have the appropriate software application to support this feature.

The plurality of posts associated with and/or corresponding to a selected hashtag may include posts authored by a plurality of users. The plurality of posts displayed in the interface may comprise a filtered view of all historical posts associated with the selected hashtag. In other aspects of the present disclosure, a user may be prohibited from selecting a hashtag included within a post if the user does not have the appropriate software application to support this feature. In some aspects of the present disclosure, the system generates the plurality of posts to be displayed in the interface by retrieving post from specific groups of users that include the hashtag. As will be described in further detail below, users may have the option of selecting privacy settings to govern which users or groups of users are permitted to view posts authored by the user. Further to the example above, based on a user's privacy setting, the system may specifically retrieve the posts authored by the user and friends of the user. In other embodiments, the system may retrieve posts authored by the user, friends of the user, and any other user that makes their posts publically available.

As will be described in further detail below, in other aspects of the present disclosure, when a user selects a hashtag included in the post of another user, the system may direct the user to an interface that displays an activity leaderboard associated with the hashtag (e.g., leaderboard interface), including performance data for each of the plurality of users that have authored a post or comment including the selected hashtag. The leaderboard interface may further showcase aggregated athletic performance data and parameters attributed to the selected hashtag (e.g., aggregated performance data for the plurality of users associated with the hashtag). In some embodiments, the leaderboard interface may showcase a ranking of the plurality of users associated with the hashtag based on one or more athletic performance parameters (e.g., distance traversed, calories burned, activity points, etc.).

In other aspects of the present disclosure, the system may allow a user to "challenge" one or more other users (i.e., athletes employing embodiments of the present disclosure) to a competition regarding athletic activities. With some implementations of the present disclosure, for example, a user may issue a challenge to one or more other athletes by tagging each of the challenge participants (e.g., users) to a post and including a unique hashtag identifying (e.g., naming) the challenge. In some aspects of the present disclosure, the user may be provided with interface options for specifying and defining the particular athletic activities activity goals that each user must achieve to complete the challenge (and/or a portion of the challenge). For example, when creating the challenge, the user may be presented with an option to establish a total distance that a challenge participant must run in order to win the challenge. In other aspects of the present disclosure, the user may identify a time period in which the one or more activities must be performed. After the challenge has been established (e.g., by publishing the post associated with the challenge), the system may monitor the posts published by each challenge participant for the duration of the challenge (or until a winner is determined). As noted above, users may associate workout sessions and athletic performance data with the posts that they publish to social networking website (or online community). The system will collect and analyze the athletic data associated with the various posts published by each participant during the duration of the challenge, and aggregates the relevant activity data values in the collected performance data. For example, if the challenge is a race to determine who can be the first to run 100 miles, for each participant the system will sum the total distance value corresponding to each post associated with (or linked to) athletic data collected for that participant after the challenge start date. When a participant has a sum of his or her total distance values that matches or exceeds the specified challenge distance (and is the first invitee to do so), then the system will identify that participant as the winner of the challenge. In some aspects of the present embodiment, the system may present a current progress of each challenge participant via a leaderboard interface, similar to the interface illustrated in FIGS. 11D and 11F.

As will be appreciated, various types of challenges may be established by a user without departing from the scope of the present disclosure. Challenges, as used herein, generally refer to goals that are competitive in nature (between multiple individuals) and have a specified deadline. Challenge types may include calorie challenges, fuel challenges and steps challenges. Calorie challenges may correspond to competitions to burn a certain number of calories while steps challenges may relate to taking a specified number of steps. Fuel challenges, as used herein, may generally refer to a virtual currency challenge. Challenges may be created by a user and published to others. Alternatively or additionally, challenges may be sponsored by an organization as a method of advertisement, fundraising and the like.

In some aspects of the present disclosure, a user may search an activity feed for posts associated with a particular hashtag. As shown in FIG. 9, a user may select search icon 903 to access a search interface that allow a user to search for posts corresponding to a particular hashtag. For example, upon selecting search icon 903, the system may present the user with search interface 1000 as shown in FIG. 10A. The user may submit a textual search for a particular hashtag in a search bar displayed in the interface so as to retrieve posts associated with the particular hashtag. As shown in FIG. 10A, interface 1000 may display a list of the top or trending hashtags. This portion of the interface may include a list of the hashtags that are the most popular with other users. Popularity may be determined by a variety of factors, such as a number of posts associated with the particular hashtag, a number of users viewing the posts associated with the particular hashtag, the amount of feedback received for the posts associated with the particular hashtag, and the like.

Figure 10B:
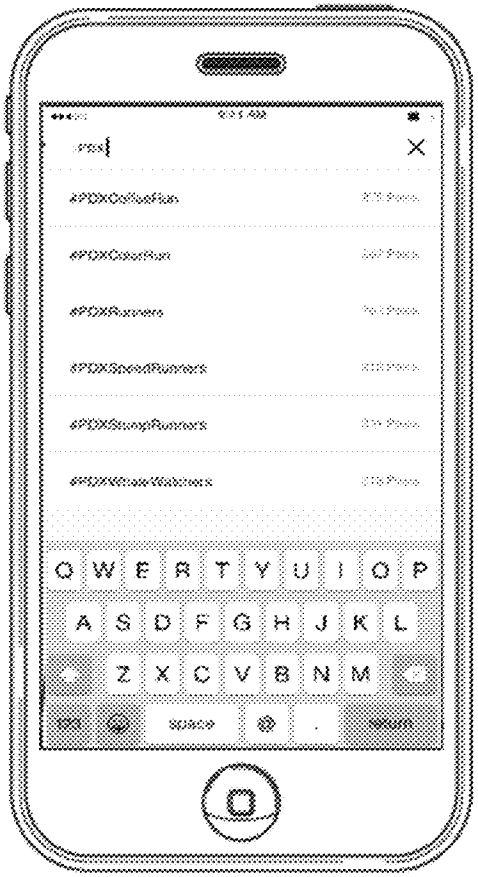
Figure 10C:
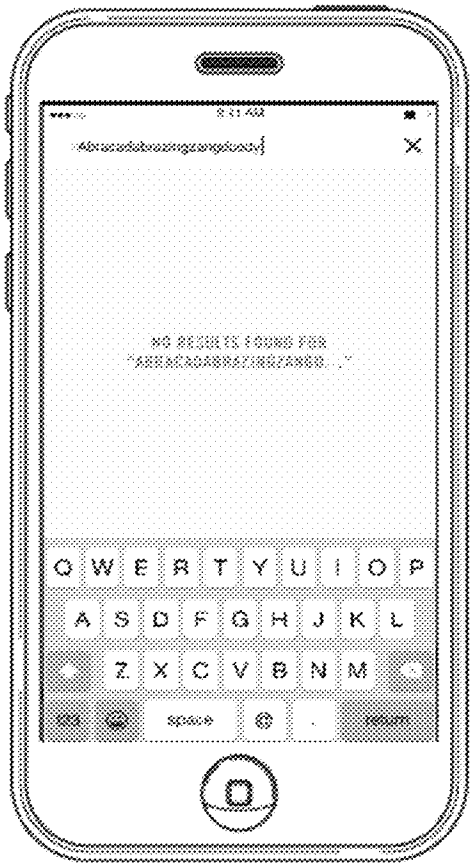

Additionally, as shown in FIG. 10A, interface 1000 may display a list of the most recent hashtag searches conducted by a user. The search interface 1000 may be configured to dynamically display a global list of hashtags in accordance with the text currently entered into the search bar. For example as shown in FIG. 10B, after a user has entered into the search bar the first three letters of their search (i.e., "#PDX"), the system may automatically display a global list of hashtags corresponding to the current search. As the user continues to include additional letters in the search, the global list of search terms corresponding to the entered search may narrow. Additionally, as shown in FIG. 10C, if a search entered by a user in the search bar does not correspond to any hashtags in the global list of hashtags, the search interface may provide a message to the user indicating that no search results can be found.

In some aspects of the present disclosure, the global list of hashtags displayed to a user may be filtered in view of the user's privacy settings and/or the privacy settings of other users. For example, when searching for a particular hashtag, the system may retrieve hashtags with posts that are publically available and/or have been authored by the user or friends of the user. In this example, the user may not be permitted to view hashtags that are associated with posts that have been authored by users having high or restrictive privacy settings. In other aspects of the present disclosure, a user may be prohibited from using the search feature of the user's privacy setting are highly restrictive (e.g., "Private" setting is activated). In such embodiments, a user may be prompted to reduce their respective privacy setting (e.g., activate a "Public" setting) in order to utilize the search feature.

Figure 11B:
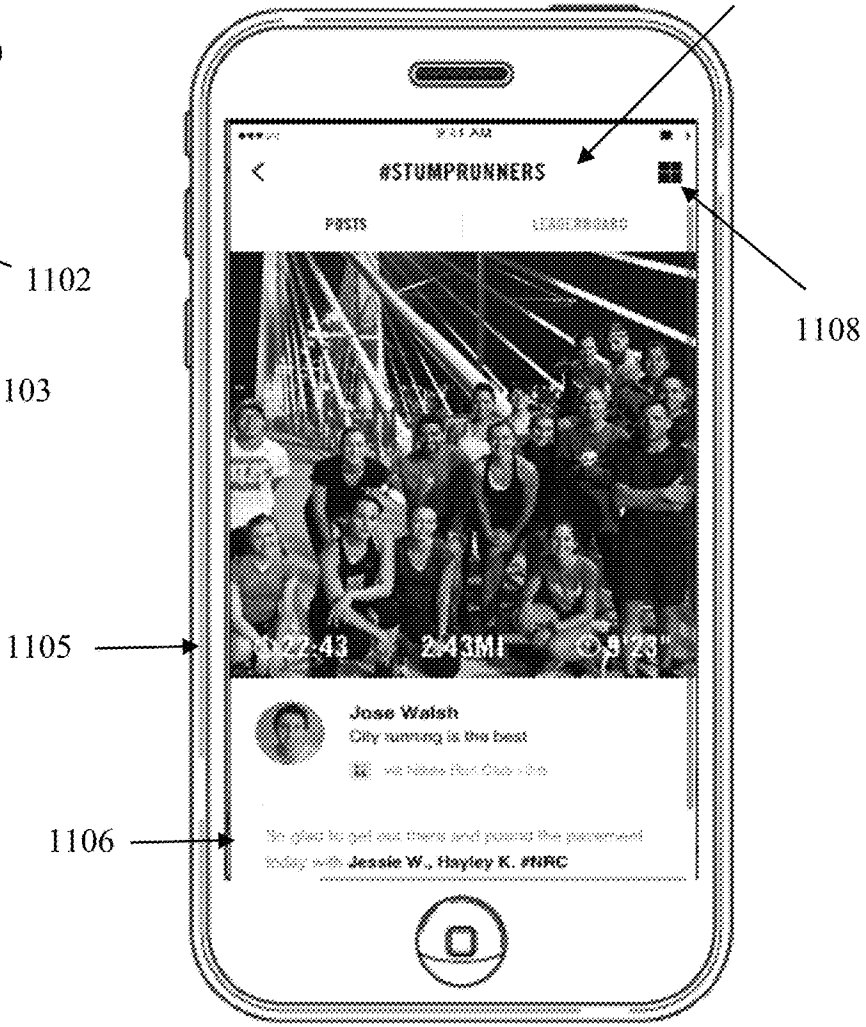
FIGS. 11A-11H show example interfaces for viewing activity posts and corresponding performance data in accordance with one or more aspects disclosed herein.
Figure 11A:
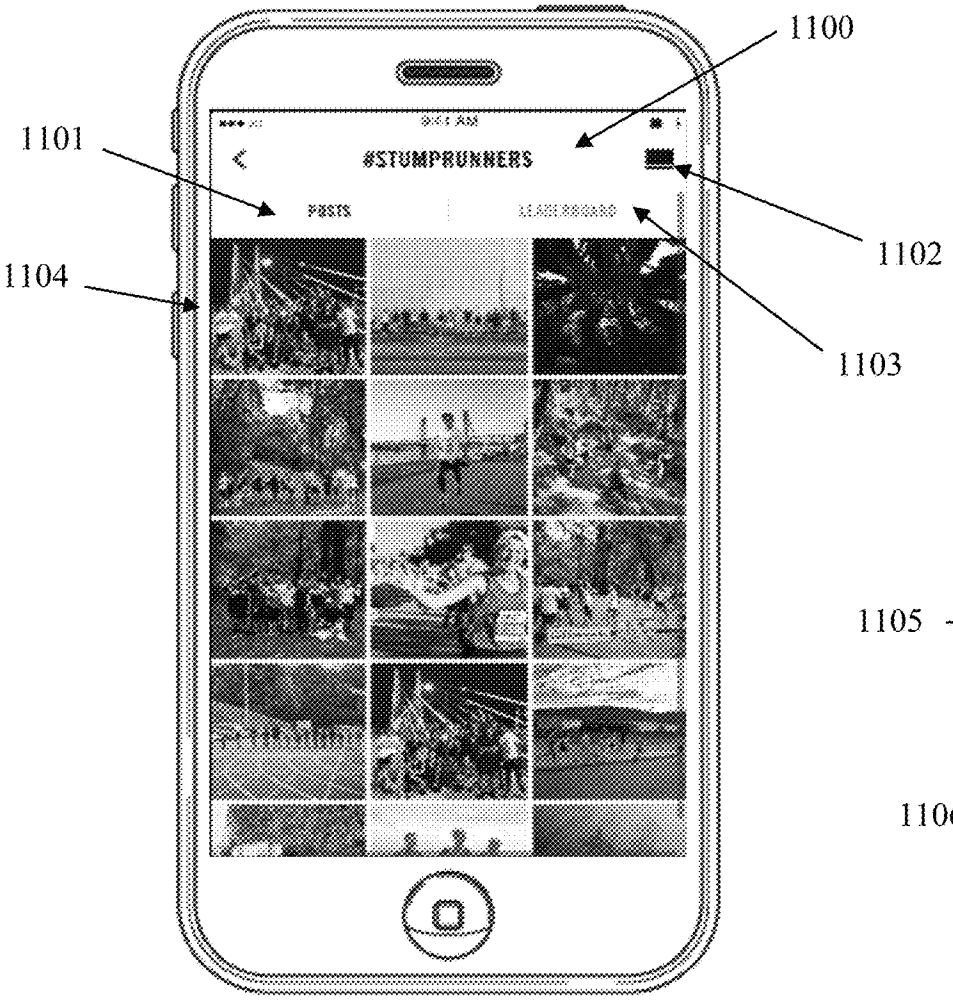

Referring now to FIG. 10*b*, in response to a user selecting a hashtag from the displayed list of hashtags, the user may be directed to an interface, such as the interface shown in FIG. 11A (i.e., interface 1100). As shown in FIG. 11A, interface 1100 may display all of the posts corresponding to a selected hashtag (e.g., "#StumpRunners"). In some aspects of the present disclosure, a portion of interface 1100 may display an identifier for the hashtag that was selected by the user. Interface 1100 may include icon 1102, which allows a user to toggle between display views. For example, by selecting icon 1102, the user may be directed to an interface that displays a normal view (e.g., full-view) of each post associated with the selected hashtag. The user may be able to scroll through each of the posts and any additional information associated with each post.

In some aspects of the disclosure, the interface 1100 may display an icon (or other image) representing a particular post. As shown in FIG. 11A, a plurality of icons, each icon representing a separate post, is displayed in interface 1100 in a matrix or grid format. In some embodiments, each icon displayed in the interface may correspond to a photo or other image associated with the underlying post. In other aspects of the present disclosure, a post corresponding to a selected hashtag (e.g., "#StumpRunners") may be displayed in interface 1100 when the hashtag was included in the original message created by the author of the post. In such embodiments, comments made by other users in response to an original post that include the selected hashtag (e.g., "#StumpRunners") in the comment may not be displayed in interface 1100. In yet other aspects of the present disclosure, a hashtag entered by other users as a comment to an original post may not cause the original post to appear in the plurality of posts associated with said hashtag. Rather, only those posts where the hashtag is included in the original message authored by the user would be retrieved for display in interface 1100.

A user may view additional icons (or posts) in interface 1100 by scrolling to see portions of the interface not currently displayed on the mobile computing device or other fitness device. As will be appreciated, the mobile computing device may be equipped with a touch-sensitive display screen configured to recognize one or more physical gestures performed by the user as user input. For example, the mobile computing device may recognize an upward finger swipe performed by the user on the touch-sensitive display screen as user input corresponding to an upward scroll. Accordingly, upon recognizing this user gesture, the mobile computing device may scroll the interface being displayed on the mobile computing device display upward. In some aspects of the present disclosure, the user may be presented with an interface option to sort the plurality of displayed posts by a variety of different parameters, such as date, popularity, performance metrics, and the like.

In some aspects of the present disclosure, in response to a user selecting icon 1104, the user may be directed to interface 1108 (e.g., the interface shown in FIG. 11B), which displays the post corresponding to icon 1104. As shown in FIG. 11B, the selected post corresponding to icon 1104, is displayed in normal view (e.g., full-view) in interface 1107. When displayed in a normal-view mode, the user may view additional information associated with the post, including information such as the name of the user that authored the post, location information associated with the post, a message or communication associated with the post, athletic performance data associated with the post (and/or corresponding workout session), and other user information. For example, as shown in portion 1105 of interface 1107, the post may display athletic performance data for an athletic activity associated with the displayed post. In this example, the post displayed in interface 1108 showcases associated athletic performance data that illustrates the user ran a distance of 2.4 miles in 22 minutes and 43 seconds, and additional performance information. Additionally, as shown in portion 1106 of interface 1107, the post may also display a message associated with the post, as well as corresponding user tags and additional hashtags. A user may view additional normal-view posts associated with the "#StumpRunners" hashtag by scrolling to see portions of the interface not currently displayed. Interface 1107 may include icon 1108, which allows a user to toggle between display views, and view the posts in a grid or matrix format.

In some aspects of the present disclosure, a user may not be permitted to view posts authored by users having certain privacy restrictions. As noted above, when publishing a post, users may have the opportunity to indicate whether the post will be made public to all users and/or whether the post should be made available for viewing by specific users or groups of users (e.g., friends, friends of friends, etc.). In other aspects of the present disclosure, the interface may prohibit a user from viewing posts authored by users having heightened privacy restrictions. As shown in FIG. 11C, the interface may indicate to a user whether (and/or the number of) posts associated with the selected hashtag are publically available to the user. In this example, interface 1109 indicates that 75 posts authored by users with heightened privacy settings (who are also not friends with the user) are associated with the "#StumpRunners" hashtag.

Figure 11D:
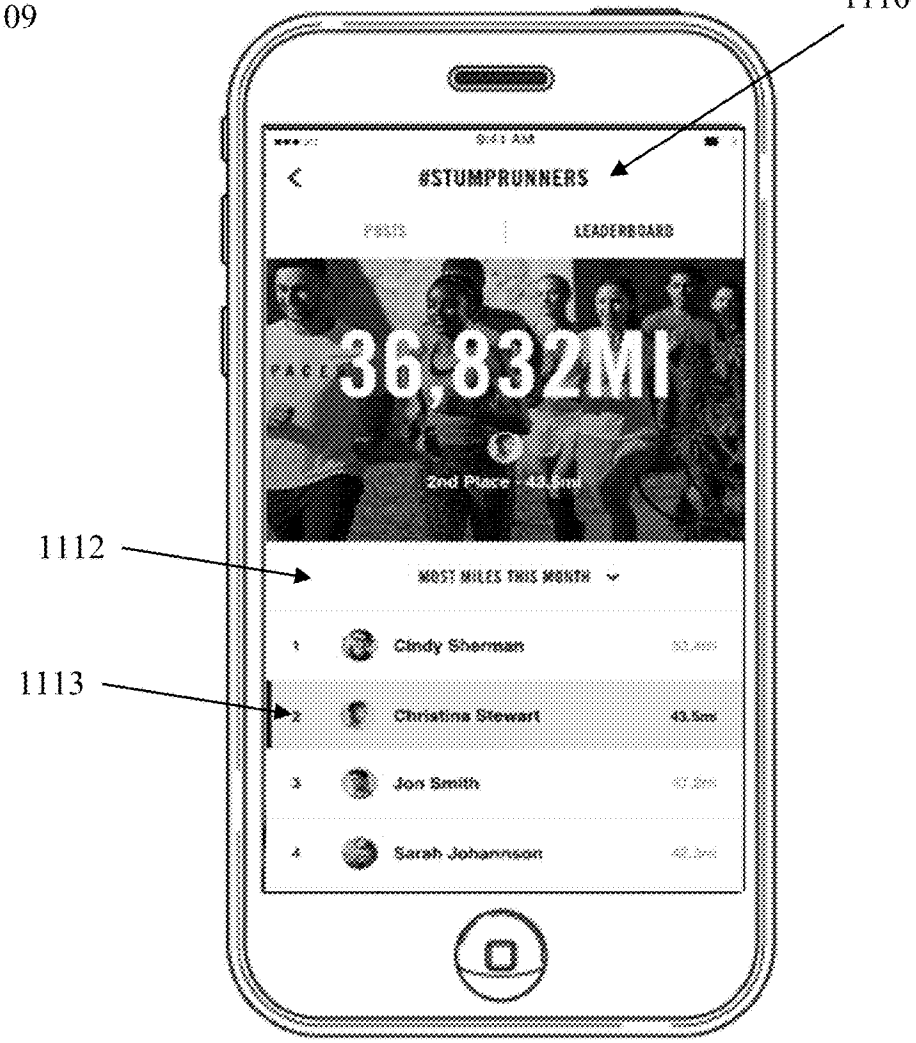
Figure 11C:
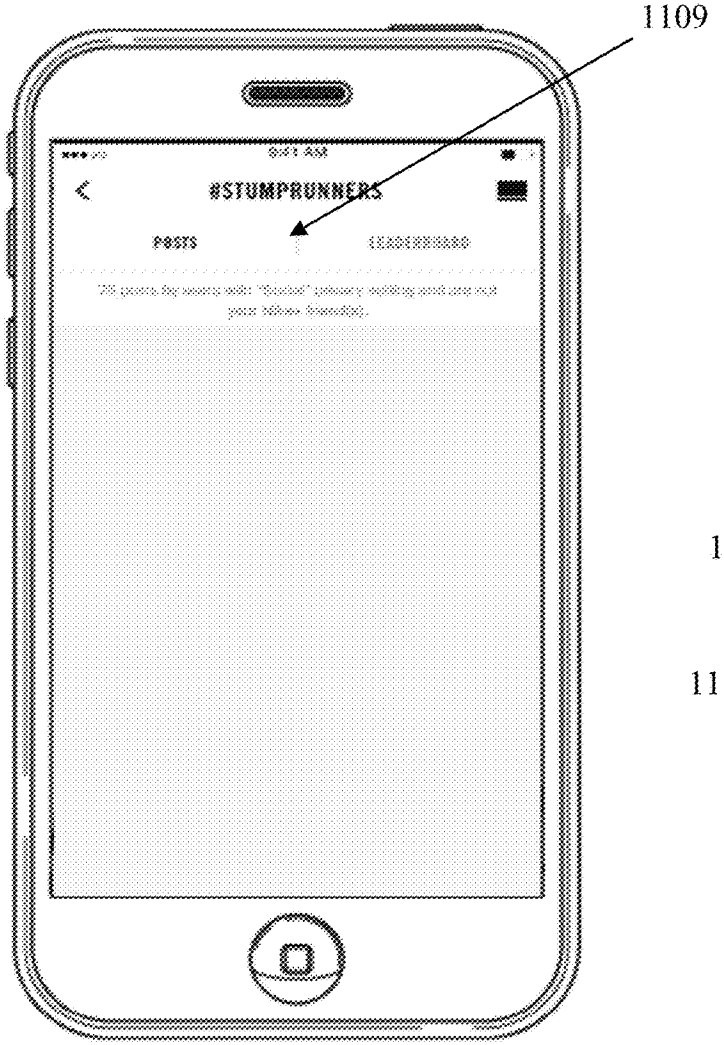

Referring back to FIG. 11A, in response to the user selecting the "Leaderboard" icon (e.g., icon 1103), as displayed in FIG. 11D, the system may direct the user to a leaderboard interface, such as interface 1110. FIG. 11D illustrates an example interface for comparing user performance metrics to other individuals in accordance with example embodiments. For example, interface 1110 may provide a leaderboard for comparison of a user's performance metric to friends and or other users, such as those users that have authored a post that includes a particular hashtag (e.g., the "#StumpRunners" hashtag). Example leaderboards may indicate the user, user's name, and a variety of performance metrics, such as a top vertical, a top tempo, a total airtime, total miles traversed, total activity points earned, and other performance metrics. Those skilled in the art will appreciate that these examples are merely exemplary, and one or more other metrics may be utilized. In this regard, combinatory metrics that consider data from multiple sensors are within the scope of this disclosure. The Leaderboard interface may rank each of the users based on a particular performance metric for a predetermined time period. The leaderboard may show how the user ranks among a large number of other users. The leaderboard may be generated based on activity data or multiple users performing the physical activities that have been associated with (and/or) tagged to posts authored by the multiple users, wherein each post is associated with (and/or includes) a particular hashtag (e.g., the "#StumpRunners" hashtag). In some aspects of the present disclosure, the leaderboard may include only those users that configured their respective privacy settings to share their posts and/or performance data publically.

Figure 11F:
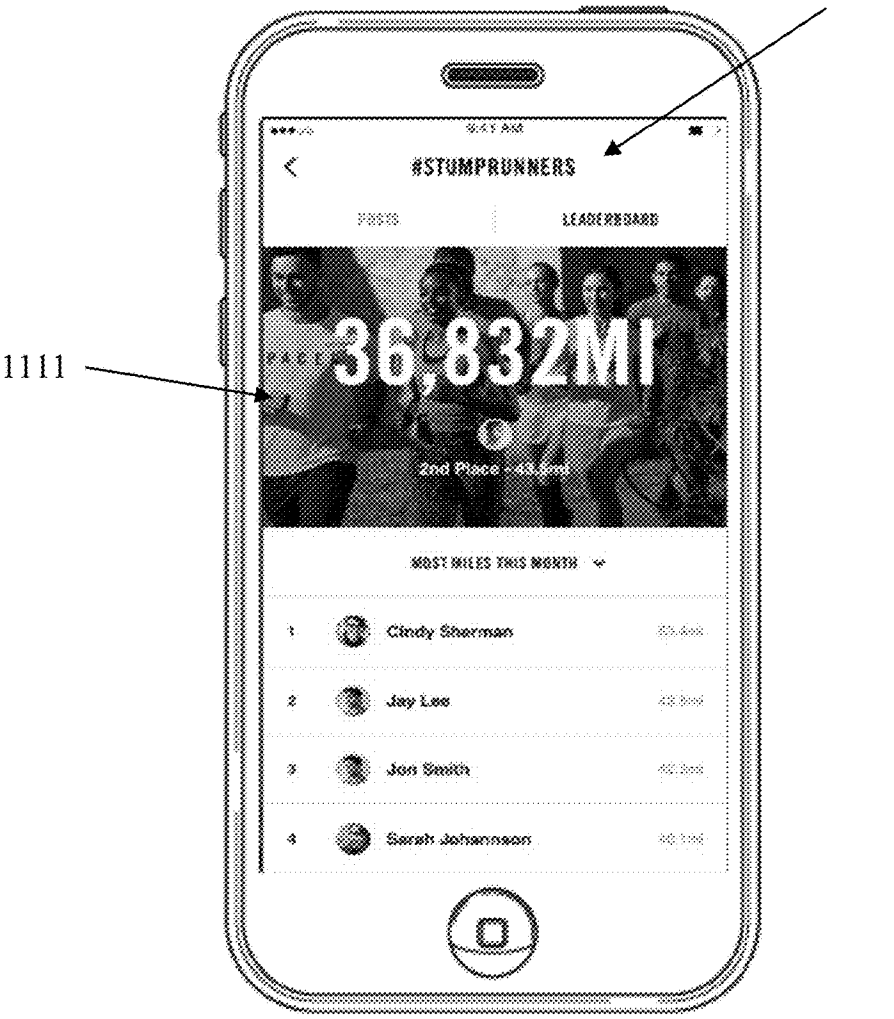
Figure 11E:
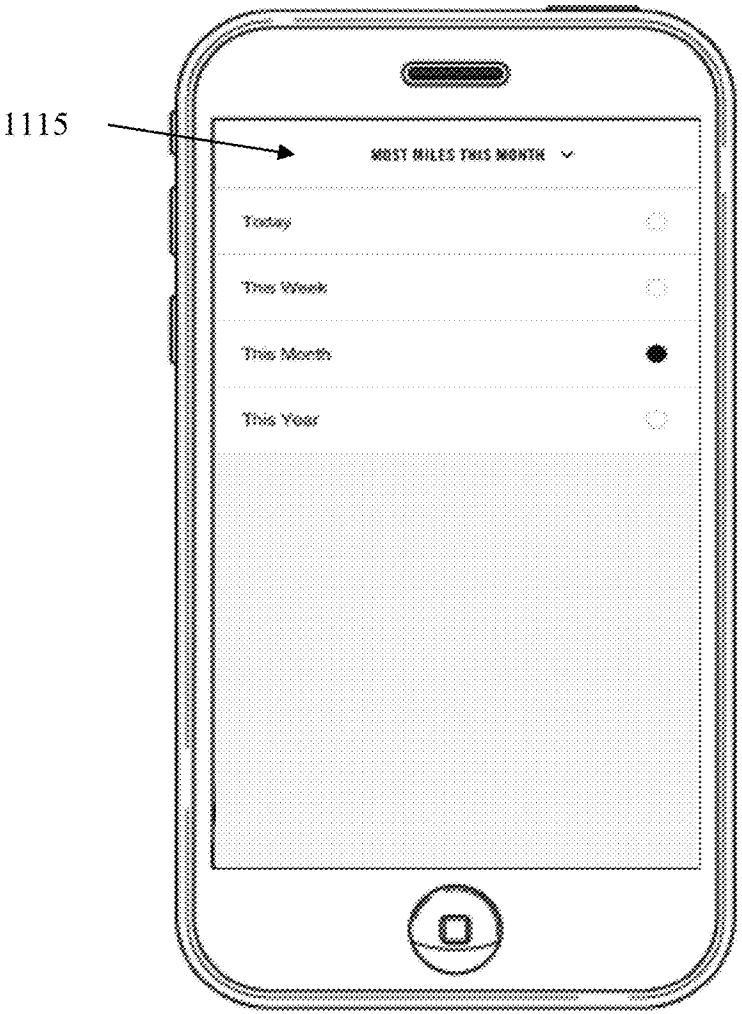

As shown in FIG. 11D, the users are ranked by a number of miles traversed within the past month. In some embodiments, the leaderboard interface 1110 may provide the user with an option to rank the various users by a specified performance metric, which may be selected from a plurality of metrics. In other embodiments, the leaderboard interface 1110 may provide the user with an option to rank the various users during a specified period of time. For example, as shown in FIG. 11D, interface 1110 may include a portion 1112 that permits a user to modify the time period utilized to rank the various users in the leaderboard. In this example, in response to a user selection portion 1112 of interface 1110, the user may be directed to interface 1115 as shown in FIG. 11E. Interface 1115 provides a user with a variety of time period options that may be used for ranking the users. For example, by selecting the "today" option in interface 1115, the system will rank users (that have authored posts associated with the "#StumpRunners" hashtag) for the leaderboard in order of the users that have run the most number of miles that day. As another example, by selecting the "This Week" option in interface 1115, the system may rank users for the leaderboard in order of the users that have run the most number of miles over the past week. Accordingly, only those users that have associated (or linked) performance data to posts that have been authored within the predetermined time period (e.g., today, this week, this month, etc.) will appear in the leaderboard interface.

In some embodiments, a portion of interface 1110 may display a performance metric indicating an accumulated amount of physical activity associated with all of the posts corresponding to a particular hashtag. For example, as shown in FIG. 11F, portion 1111 of interface 1110 displays a cumulative number of miles associated with all off the posts relating to the "#StumpRunners" hashtag. In other aspects of the present disclosure, portion 1111 may also indicate a user's current rank in the leaderboard, and may also display a cumulative amount of activity associated with posts relating to a particular hashtag (i.e., "#StumpRunners" hashtag) that were authored by the user over a predetermined time period.

Figure 11H:
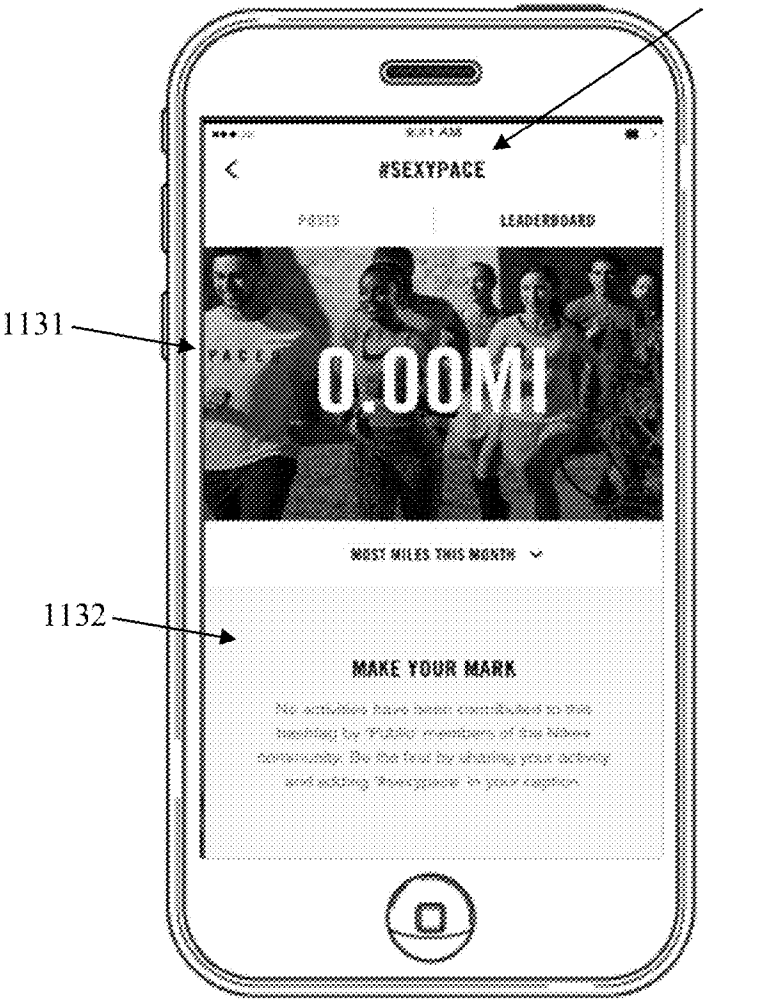
Figure 11G:
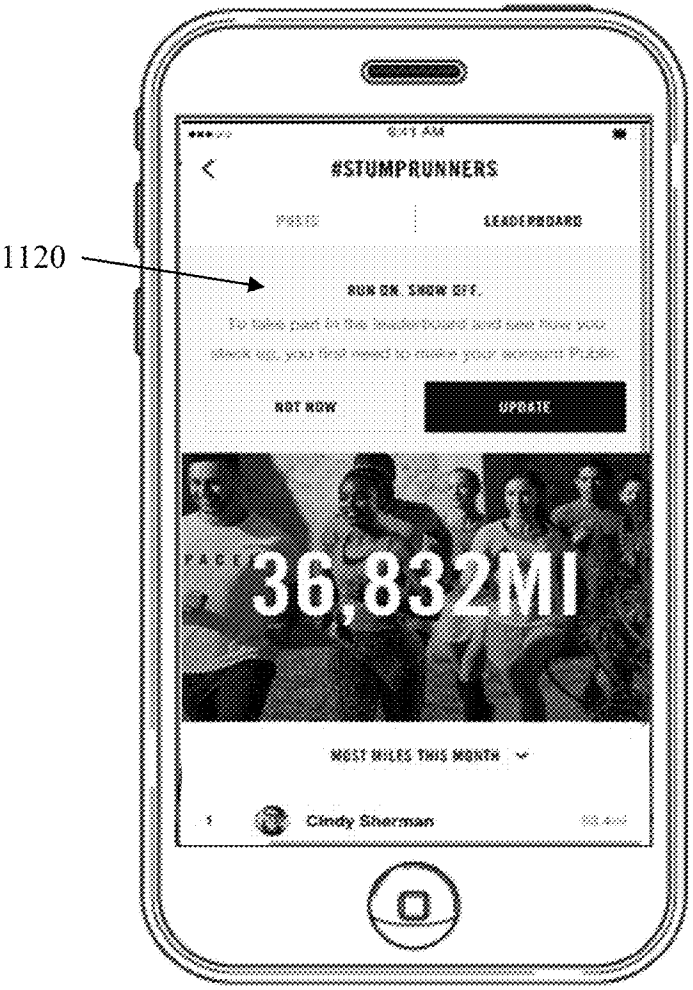

As noted above, in some embodiments, a user may have the option of selecting one or more privacy restrictions for posts that are made available to the public and/or one or more users or groups of users. For example, a user may choose to allow only those users that are friends with the user to view the user's authored posts and associated data. In other embodiments, a user may be prohibited from viewing leaderboard information and/or including their performance data in a leaderboard when certain privacy settings are activated. In one of these embodiments, a user may be prohibited from being included in a performance leaderboard if the user has failed to make their posts and corresponding performance data available to the public. In some of these embodiments, the system may prompt the user to modify a privacy setting in order to view leaderboard information. For example, as shown in FIG. 11G, interface 1120 may prompt the user to toggle their account profile from private to public (e.g., "Social") by selecting the "Update" icon. Alternatively, the user may decide to maintain certain privacy settings by selecting the "Not Now" icon in interface 1120. In other embodiments, the user may be presented with a privacy settings interface that provides the user with options for adjusting a desired level or privacy (e.g., toggling between "Private" and "Social" settings).

In embodiments, where a user authors a post that includes a hashtag that has not previously been utilized by other users, the interface may not identify any performance data associated with related posts. For example, as shown in FIG. 11H, a user may author a post that includes a particular hashtag (i.e., "#SexyPace") that has not been previously utilized by other users. Accordingly, as shown in portion 1131 of interface 1130, the accumulated (or aggregated) performance data (e.g., total miles ran over the past month) for users that have authored posts associated with this particular hashtag within the predetermined time period (e.g., this month) is zero. As shown in portion 1132 of interface 1130, the system may communicate a message to a user indicating that no publically-available posts utilizing the "#SexyPace" hashtag have been authored. In this example, as users begin to author publically-available posts utilizing the "#SexyPace" hashtag and associate their respective performance data with these posts, a leaderboard may be generated, and subsequently displayed, such as in interface 1130. In some embodiments, the leaderboard will dynamically populate users and their respective performance data as posts utilizing the "#SexyPace" hashtag are authored. In some aspects of the present disclosure, interface 1130 may be configured to dynamically update user performance data and leaderboard rankings in real-time.

Certain aspects of this disclosure relate to single posts containing multiple hashtags. Where multiple hashtags are used within a single post, the performance data included in the post may contribute to the user's ranking in each of the leaderboards associated with the hashtags.

As described, leaderboards may be automatically generated based on hashtags included in posts made by users. As a result, users are not required to take any specific action in order to setup or participate in a leaderboard. Consequently, the user interface and interaction with the system is simplified. Users are also able to dynamically modify which leaderboards activities contribute towards by adjusting the hashtags included in their posts. Accordingly, they can easily omit certain activities from some or all leaderboards, if desired.

Workout information for a user may be shared through other channels including a fitness monitoring service provider site, a personal homepage and the like. In some arrangements, the user may be able to publish workout information to multiple sites or services simultaneously or non-simultaneously through a single sharing interface. According to one or more arrangements, a user may further access a remote fitness monitoring service site and receive data through the mobile fitness monitoring device. For example, interfaces may be generated by the mobile monitoring device based on data received from the remote fitness monitoring site through a network. A user may login and/or register with the remote fitness monitoring service through an interface presented to the user. Once a user has entered user information and/or login information, the user may navigate through various user interfaces displaying user athletic activity records, achievements, schedules, progress and the like.

When a user completes a goal, workout, reaches a milestone, completes an objective, makes progress or completes an improvement run, a user may be provided with encouraging or celebratory messages. Alternatively or additionally, cheers, words of encouragement and/or other messages may be provided pre- or mid-run. These messages may include audio, video, images, animated images, tactile or haptic feedback (e.g., vibrations) and the like. In one or more arrangements, the celebratory messages may include audio and/or video messages from a celebrity such as a well-known athlete. The user may be allowed to configure when such messages are to be rendered and conveyed to the user. For example, the user might not want celebratory messages during the run and thus, may indicate a preference that all messages be played after a workout or during non-workout times. Accordingly, the user may specify when messages are not to be conveyed as well. Additionally or alternatively, celebratory messages may include sound effects such as a crowd cheering, a bullhorn, cowbell ringing, vuvuzela blasts, fireworks exploding, slot machine jackpot sounds among others.

In some aspects of the present disclosure workout session announcement may be posted or otherwise provided to an on-line community such as a user's social networking site or conveyed through an on-line community such as a social networking service (e.g., TWITTER) before, during or after a workout. The announcement may indicate a type of workout that the user is pursuing (e.g., a marathon training run) and a message encouraging other users (e.g., friends and family) to leave comments or indicate approval (or disapproval) of the workout. A number of comments or indications of approval may be displayed in conjunction with the announcement as well. In some arrangements, multiple types of feedback and/or feedback from multiple different and/or distinction on-line communities or remote network sites (e.g., social networking services) may be aggregated to determine the amount of feedback received.

For example, a number of comments may be added to a number of approval indicators received. In other arrangements, each type of feedback may be counted separately. Additionally or alternatively, only positive feedback or feedback matching one or more predefined rules or parameters (e.g., type of content, words, characters, symbols, etc. used in the feedback, identity of an author/commenter and the like) may be counted towards the amount of feedback. In still other examples, the type of content or message selected for delivery to the user may be based on matching one or more predefined parameters or rules other than or in addition to an amount of feedback. For example, such parameters or rules may include type of content (video, audio, and text), words, characters, symbols, etc. used in the feedback, identity of an author/commenter and the like.

Determining an amount of feedback received may include receiving the comments from an on-line community (e.g., social networking site) and counting the amount of feedback received (e.g., a number of comments). In another example, determining the amount of feedback may include receiving an indication of a number of comments or feedback received in response to the posted workout information. In other examples, determining the amount of feedback may be performed by another computing device or remote server. The other device may then provide the determination of the amount of feedback to an athletic monitoring system. The other device may also be configured to select the content (e.g., sound effect, video, text, haptic feedback) to be provided to the user. Providing the determination of the amount of feedback may also be performed from one software or hardware module of a device (e.g., an athletic performance monitoring device) to another software or hardware module of that same device. Provision of the determination of the amount of feedback may also include storage of the determination of the amount of feedback in memory.

According to some arrangements, the determination of the amount of feedback and the selection of the content may be performed by different devices such as an athletic performance monitoring service and an athletic performance monitoring device.

Alternatively, the determination and the content selection may be performed by the same device. In still other arrangements, the determination of the amount of feedback and/or the selection of content may be performed by the on-line community (e.g., the social networking system).

In some aspects of the present disclosure, the workout announcements may provide statistics and metrics associated with the completed workout and/or athletic activity. For example, a distance run, a time run and/or a pace (e.g., an average pace, fastest pace, slowest pace, etc.) may be displayed in the workout announcement. Other users may be allowed to comment on the announcement and celebratory messages may be provided to the user as described above.

In other embodiments, in addition (or as an alternative) to submitting textual comments and/or approval indicators in response to the workout announcement, friends and other users may also record audio and/or video messages to be played to the user. For example, a friend has recorded an audio message in response to a received workout announcement. The audio message may be immediately played to the user or may be played according to a trigger selected by the creator of the audio message 6513 (e.g., completion of the workout, reaching a specified distance, time or pace goal, receiving a certain number of total comments or other type of feedback, etc.). Alternatively or additionally, the user performing the workout may select the triggering event for receiving audio messages left by friends and other individuals. Sound effects may be used as an efficient way to notify the user that they have received a certain amount of positive feedback without requiring the user to listen to or view a lengthy audio or visual message.

Figure 12:
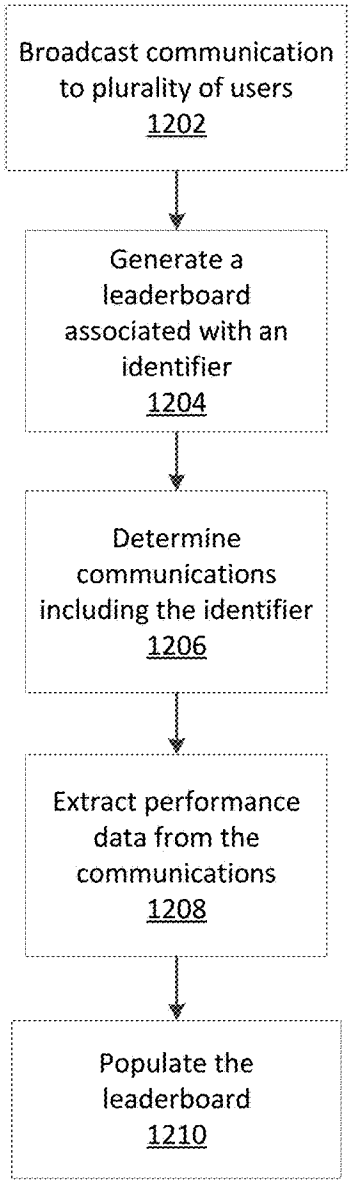
FIG. 12 shows a flow diagram illustrating that may be implemented based in accordance with one embodiment.

FIG. 12 shows an example flow diagram that may be partially or wholly implemented in one or more methods of tracking user athletic activity in accordance with aspects of this disclosure. Such tracking may be conducted in accordance with the discussion herein, including with reference to FIGS. 7A-11G discussed above, and as such, that disclosure should be considered with respect to the various embodiments of FIG. 12. As shown in FIG. 12, an electronic communication may be transmitted to a plurality of users. The communication may include an identifier associated within an athletic activity performed by a user within a community of users. In some aspects of the present embodiment, the communication may include performance data for the user associated with the performed athletic activity or previous athletic activities performed by the user (e.g see block 1202 of FIG. 12). One or more communications may be sent to the various users of the community over a time period (e.g., 1 day, 1 week, 1 month, etc.). The identifier may be associated with the performance data obtained for the user.

Either as part of this or another implementation, the system may generate a leaderboard that identifies various users within the community of users. In some aspects of the present disclosure, the information presented on the leaderboard may be associated with the identifier included in the communication transmitted during step 1202 (e.g see block 1204 of FIG. 12). In other aspects of the present disclosure, the system may determine which communications transmitted to the user include a particular identifier. The system may be configured to extract performance data from communications that are associated with particular identifier. The extracted data may be associated with one or more other users that have previously performed athletic activities. In some embodiments, the system may populate the leaderboard with one or more users based on athletic performance rankings. For example, the system may populate the leaderboard with a one or more users based on performance data associated with respective activities performed by the users, such as athletic activities relating to the identifier associated with the leaderboard, as described above concerning step 1204 (e.g see block 1210 of FIG. 12).

CONCLUSION

Providing an activity monitoring system and environment having one or more of the features described herein provides a user with an immersive experience that will encourage and motivate the user to engage in athletic activities and improve his or her fitness. By encouraging the user to exceed previous statistics set in other runs, the user may be motivated by the improvements he or she is able to make. Additionally, users may be able to use a single device for both indoor and outdoor workouts and are thus able to aggregate workout data on a single device. Further, users may be motivated to exercise by being able to issue live challenges to other users. Accordingly, the users may feel as if they are working out with other users even though they are physically running by themselves.

We claim:

1. A method comprising:

broadcasting, by a computing device, an electronic communication to a plurality of users including one or more user-selected metadata tags indicating a first athletic activity performed by a first user of the plurality of users, a first set of performance data of the first user during the first athletic activity, and a first set of one or more content items associated with the first athletic activity;

generating for display, by the computing device, a user interface, wherein the user interface indicates, on a first display, the first set of performance data and the first set of one or more content items associated with the first athletic activity;

in response to selection with an input device of the user interface, receiving a first user input requesting display of at least one of a second set of performance data and a second set of one or more content items associated with the first athletic activity performed by one or more other users of the plurality of users;

after receiving the first user input, determining, by the computing device, a set of communications by one or more other users of the plurality of users that include the one or more user-selected metadata tags and the second set of performance data of the one or more other users;

filtering, by the computing device and based on the set of communications, the second set of performance data of the one or more other users and the second set of one or more content items associated with the first athletic activity based on one or more athletic activity parameters; and generating for display, by the computing device and via the user interface, the filtered second set of performance data and the second set of one or more content items associated with the first athletic activity performed by one or more other users of the plurality of users.

2. The method of claim 1, further comprising:

receiving a second user input for requesting display of a leaderboard in response to selection with the input device of an interface element on the user interface; and in response to receiving the second user input, displaying, by via the user interface and based on the first and second sets of performance data, a leaderboard of the plurality of users associated with performance of the first athletic activity.

3. The method of claim 2, wherein, where a user of the plurality of users includes the one or more user-selected metadata tags in a plurality of communications including performance data associated with a plurality of athletic activities performed by the user, the user is ranked on the leaderboard based on a cumulative value of the performance data.

4. The method of claim 2, wherein ranking the users on the leaderboard is based on a performance metric derived from the first and second sets of performance data.

5. The method of claim 2, wherein the plurality of users are ranked on the leaderboard for a selected time period.

6. The method of claim 1, further comprising:

detecting, by the computing device, a user-selected metadata tag, of the one or more user-selected metadata tags, in a communication comprising a third set of performance data associated with the first athletic activity; and in response to detecting the user-selected metadata tag, generating for display, via the user interface, a leaderboard of the plurality of users indicating performance data associated with the first athletic activity.

7. The method of claim 6, wherein generating for display the leaderboard further comprises:

displaying, via the leaderboard and based on the second set of performance data associated with the first athletic activity included in the communication contributes to a ranking of one or more users, of the plurality of users, on the displayed leaderboard.

8. The method of claim 1, wherein the one or more user-selected metadata tags is a hashtag.

9. The method of claim 1, wherein the one or more content items comprise at least one of a text, a video, and an image.

10. The method of claim 1, wherein a plurality of leaderboards are generated for different user-selected metadata tags used in a plurality of electronic communications sent by the plurality of users.

11. The method of claim 10, wherein the plurality of leaderboards are searchable based on the different user-selected metadata tags.

12. An apparatus comprising:

at least one processor;

an input device; and at least one memory storing computer executable instructions that, when executed by the at least one processor, cause the processor to at least:

broadcast, to a plurality of users, an electronic communication including one or more user-selected metadata tags indicating a first athletic activity performed by a first user, a first set of performance data of the first user during the first athletic activity, and a first set of one or more content items associated with the first athletic activity;

generate for display a user interface, wherein the user interface indicates, on a first display, the first set of performance data and the one or more content items associated with the first athletic activity;

in response to selection with the input device of the user interface, receiving a first user input requesting display of at least one of a second set of performance data and a second set of one or more content items associated with the first athletic activity performed by one or more other users of the plurality of users;

after receiving the first user input, determine a set of communications by one or more other users of the plurality of users that include the one or more user-selected metadata tags and the second set of performance data of the one or more other users;

filter, based on the set of communications, the second set of performance data of the one or more other users and the second set of one or more content items associated with the first athletic activity based on one or more athletic activity parameters; and generate for display, via the user interface, filtered second set of performance data and the second set of one or more content items associated with the first athletic activity performed by one or more other users of the plurality of users.

13. The apparatus of claim 12, wherein the computer executable instructions, when executed by the at least one processor, further cause the apparatus at least to:

receive a second user input for requesting display of a leaderboard in response to selection with the input device of an interface element on the user interface; and in response to receiving the second user input, displaying, by via the user interface and based on the first and second sets of performance data, a leaderboard of the plurality of users associated with performance of the first athletic activity.

14. The apparatus of claim 13, wherein ranking the users on the leaderboard is based on a performance metric derived from the performance data.

15. The apparatus of claim 13, wherein the users are ranked on the leaderboard for a selected time period.

16. The apparatus of claim 12, wherein the computer executable instructions, when executed by the at least one processor, further cause the apparatus at least to:

detecting a user-selected metadata tag, of the one or more user-selected metadata tags, in a communication comprising a third set of performance data associated with the first athletic activity; and in response to detecting the user-selected metadata tag, generating for display, via the user interface, a leaderboard of the plurality of users indicating performance data associated with the first athletic activity.

17. The apparatus of claim 12, wherein the performance data includes distance, time and/or pace.

18. The apparatus of claim 12, wherein the user-selected metadata tag is a metadata tag.

19. The apparatus of claim 18, wherein the one or more user-selected metadata tags is a hashtag.

20. A method comprising:

broadcasting to a plurality of users a first communication indicating a first athletic activity performed by a first user;

determining, by a processor, a first user-selected metadata tag associated with the first communication;

determining, by the processor, a plurality of other communications corresponding to the first user-selected metadata tag;

electronically receiving performance data for a plurality of other users associated with the plurality of other communications; and generating, by the processor, a leaderboard indicating a first ranking of the first user and the plurality of other users in accordance with one or more athletic activity parameters.

* * * * *